US006262756B1

(12) United States Patent
Kashino et al.

(10) Patent No.: US 6,262,756 B1
(45) Date of Patent: Jul. 17, 2001

(54) THERMAL DEVELOPMENT APPARATUS

(75) Inventors: Teruo Kashino; Akira Taguchi; Yosuke Tateishi; Yasuaki Tamakoshi, all of Sayama (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/438,265

(22) Filed: Nov. 10, 1999

(30) Foreign Application Priority Data

Nov. 16, 1998 (JP) ..... 10-341186

(51) Int. Cl.[7] ..... B41J 19/00
(52) U.S. Cl. ..... 347/215; 347/288
(58) Field of Search ..... 399/271, 16, 388, 399/396, 394, 400, 68; 271/316, 264, 270; 347/215, 288

(56) References Cited

U.S. PATENT DOCUMENTS 4,071,295 * 1/1978 Komori et al. ..... 399/394
6,017,684 * 1/2000 Miyake ..... 430/351

FOREIGN PATENT DOCUMENTS 10-500497 1/1998 (JP) .

* cited by examiner

*Primary Examiner*—N. Le
*Assistant Examiner*—K. Feggins
(74) *Attorney, Agent, or Firm*—Frishauf, Holtz, Goodman, Langer & Chick, P.C.

(57) ABSTRACT

In a thermal development apparatus provided with a drum to heat a thermally developable material on an outer circumferential surface thereof while rotating at a predetermined constant rotation speed; a feeding device which feeds a sheet-like thermally developable material onto the outer circumferential surface of the drum, whereby the thermally developable material fed by the feeding device is thermally developed by being heated while being held on the outer circumferential surface of the drum; the feeding device feeds each of thermally developable materials to the drum with a timing to shift a position of a leading end of each of thermally developable materials to be held on the drum into a rotation direction of the drum with the shortest time interval Tmin or longer among the thermally developable materials fed onto the drum so as to be continuously heated by the drum.

31 Claims, 10 Drawing Sheets

THERMAL DEVELOPMENT APPARATUS

BACKGROUND OF THE INVENTION

The present invention relates to a thermal development apparatus as well as a thermal development method in which an image is formed by feeding a thermally developable material on the outer circumferential surface of a drum and heating it.

A thermal development apparatus is developed in which by successively feeding a sheet of thermally developable material onto the outer circumferential surface of a heated drum, the thermally developable material undergoing a thermal reaction so that an image formed as a latent image will be visible (refer to Japanese Patent Publication Open to Public Inspection under PCT Application No. 10-500497). Such a thermal development apparatus is constituted in such a manner that sheets of thermally developable material are fed onto the outer circumferential surface of a drum which rotates at a constant speed; after the drum rotates a specified angle, while the material is held on the surface, the thermally developable material, which has been heated, is peeled from the outer circumferential surface of the drum; at the same time, another sheet of thermally developable material is fed onto the outer circumferential surface of the drum; and thus, sheets of thermally developable material can be efficiently heated.

Such a thermal development apparatus has been supposed to be preferable based on the fact that when time TR required for one rotation of the drum is the same as the interval between the time when the leading edge of the sheet of thermally developable material is fed to the drum and the time when the following sheet is fed to the same, the sheets of thermally developable material which are seccessively heated by the drum can be developed under the same conditions, and further, a sheet of thermally developable material catching mechanism can be provided onto the drum.

However, when an apparatus is constructed in the manner as described above, it has been found that after many sheets of thermal developable materials are thermally developed, uneven density results at the leading edge portion as well as the rear edge portion, in the drum rotation direction. In particular, it has also been found that in an apparatus which can thermally develop sheets of thermally developable materials of a plurality of sizes in the drum rotational direction, small-sized sheets of thermally developable material are thermally developed, and thereafter, when a larger-sized sheet of thermally developable material is thermally developed, uneven density results in the center of the image, markedly degrading the image quality of the larger size.

In view of such problems, an object of the present invention is to minimize such uneven density and to make it possible to carry out thermal development to yield high image quality at high speed.

Furthermore, a drum in a thermal development apparatus based on conventional techniques is constructed on the assumption that single-sized sheets of thermally developable material will be employed. It is supposed that the drum is not constructed so as to heat different-sized sheets of thermally developable material. Accordingly, when a drum based on conventional techniques is employed to heat sheets of thermally developable material of different sizes without any adjustment, mismatching between the circumference of the drum and the length of the sheet of thermally developable material in the drum rotation direction occurs. For example, due to the excessively small diameter of the drum, curl and the like tend to result on the sheets.

Furthermore, in view of such problems of conventional techniques, an object of the present invention is to provide a thermal development apparatus as well as a thermal development method which can correspond to different-sized sheets of thermally developable material and can also ensure high image quality, while forming images in a short period of time.

SUMMARY OF THE INVENTION

The inventors of the present invention have diligently investigated causes of the formation of the aforementioned uneven density. As a result, the following has been discovered to create the present invention. Means to overcome the above-mentioned problems are described below.

(1) In a thermal development apparatus which comprises a drum to heat a thermally developable material on its outer circumferential surface while rotating at a predetermined rotation speed and a feeding means which feeds a sheet-like thermally developable material onto the outer circumferential surface of the drum, and thermally develop the thermally developable material fed by the feeding means by heating it while holding it on the outer circumferential surface of the drum, the feeding means feeds each of thermally developable materials to the drum with a timing to shift a position of the leading end of each of thermally developable materials held on the drum into a rotation direction of the drum among the thermally developable materials fed onto the drum with the shortest time interval Tmin so as to be continuously heated by the drum.

The position of each of thermally developable materials among the thermally developable materials fed onto the drum with the shortest time interval Tmin is shifted in the rotation direction of the drum to a different position from others, it is possible to maintain the entire outer circumferential surface of the drum at the same temperature by varying the position at which the leading edge of the sheet of the thermally developable material is held without resulting in a decrease in temperature at only one portion of the outer circumferential surface of the drum. As a result, it is possible to minimize the formation of uneven density and to improve image quality obtained by thermal development.

With this structure, the shortest time interval Tmin and a time period TR during which the drum rotates a single rotation satisfy the following formula in terms of arbitrary natural number N.

$$Tmin \neq N \times TR$$

(2) In the thermal development apparatus described in (1), formula 1 described below is satisfied in terms of arbitrary natural number N;
formula 1:

$$(N-1/20)\times TR \geqq Tmin$$

or $$(N+1/20)\times TR \leqq Tmin$$

wherein Tmin denotes the shortest time interval between the time when the leading edge of the sheet of thermally developable material is fed to the drum and the time when the following sheet is fed to the drum, TR denotes the time required for one rotation of the drum.

Since the position of each of thermally developable materials fed on the drum is different by at least 1/20 of the circumference of the drum from others among the thermally developable materials continuously heated by the drum, uneven temperature on the drum in the rotational direction is less likely to result, and owing to that, it is possible to effectively minimize the formation of uneven density.

(3) In the thermal development apparatus described in (2), formula 2 described below is satisfied in terms of arbitrary natural number N;

formula 2:

$$(N-1/20)\times TR \geqq 2\times Tmin$$

or $$(N+1/20)\times TR \leqq 2\times Tmin$$

wherein Tmin denotes the shortest time interval between the time when the leading edge of the sheet of thermally developable material is fed to the drum and the time when the following sheet is fed to the drum, TR denotes the time required for one rotation of the drum.

Since the position of each of thermally developable materials fed on the drum is different by at least 1/20 of the circumference of the drum from others among the thermally developable materials continuously heated by the drum on the basis of every other sheet, uneven temperature on the drum in the rotational direction is less likely to result, and owing to that, it is possible to effectively minimize the formation of uneven density.

(4) In the thermal development apparatus described in (3), an existing ratio of natural number N which satisfy all formulas 3 to 5 described below is 50 percent or more in terms of an arbitrary natural number.

formula 3:

$$(N-1/20)\times TR \geqq T(n)$$

or $$(N+1/20)\times TR \leqq T(n)$$

formula 4:

$$(N-1/20)\times TR \geqq T(n+1)$$

or $$(N+1/20)\times TR \leqq T(n+1),$$

formula 5:

$$(N-1/20)\times TR \geqq T(n)+T(n+1)$$

or $$(N+1/20)\times TR \leqq T(n)+T(n+1)$$

wherein TR denotes the time required for one rotation of the drum, T(n) denotes the interval between the time when the leading edge of a sheet of thermally developable material is fed at n-th order to the drum and the time when the leading edge of the following sheet of thermally developable material is fed at (n+1)-th order to the drum.

Among the thermally developable materials continuously heated by the drum, that is, not only among the thermally developable materials fed to the drum with the shortest time interval Tmin, but also among the thermally developable materials fed to the drum with the more long time interval, the probability of the leading edge of the sheet of thermally developable material being substantially fed onto the same position of the drum becomes low. As a result, areas of uneven temperature on the drum in the rotational direction are not likely to result, and owing to that, it is possible to effectively minimize the formation of uneven temperature.

Incidentally, the existing ratio of the natural number n which satisfies the above formulas may be obtained in such a manner that each time when during develop-processing the number of M sheets of thermally developable materials, the leading edge portions of these sheets of thermally developable materials are fed onto the drum is recorded, and the percentage of the natural number n which satisfies the above formula is obtained employing time TR for one rotation of the drum, however the method obtaining the number is not limited to this. Furthermore, from the viewpoint of effective minimization of the uneven density, the existing ratio of natural numbers which satisfy the above formulas are preferably at least 70 percent (and more preferably at least 90 percent). Although, the number of M is 100 sheets in the example, it may be preferable that the number of M is 100 sheets or more.

(5) In the thermal development apparatus described in (4), the feeding means feeds the thermally developable material to the drum through a predetermined feeding path at a predetermined conveying speed, there is provided an exposing means to expose the thermally developable material on the feeding path, the exposing means exposes on the basis of image data produced with a random time interval the thermally developable material with the shortest time interval Tmin or with a random time interval if a time interval exceeds the shortest time interval Tmin, and the feeding means feeds the thermally developable material onto the drum with a random time interval if a time interval exceeds the shortest time interval Tmin.

Since the time interval to produce the image data is random depending on the image data, the exposing time interval is the shortest time interval Tmin in the case that the time interval to produce the image data is shorter than the shortest time interval Tmin, and the exposing time interval is random in the case that the time interval to produce the image data exceeds the shortest time interval Tmin. When the feeding means feeds the thermally developable material through the predetermined feeding path at the predetermined conveying speed, the feeding means feeds the thermally developable material with the shortest time interval Tmin or a random time interval if the feeding time interval exceeds the shortest time interval Tmin. In these cases, the shortest time interval Tmin satisfies formula 1 or formula 2 in terms of arbitarary natural numerals N. Therefor, among the arbitarary natural numerals N, the existing ratio of the natural numerals N satisfying all of the formula 3 to 5 becomes 50% or more. The probability that the leading end of the thermally developable material is continuously fed to the substantially same position on the drum becomes low, unevenness in temperature in terms of the rotation direction of the drum hardly occurs. As a result, the unevenness in temperature can be efficiently prevented.

(6) In the thermal development apparatus described in (5), the feeding means has on the feeding path a conveying direction changing section to change the conveying direction by conveying out the thermally developable material in a conveying-out direction different from a conveying-in direction in which the thermally developable material is conveyed in; the conveying direction changing section conveys out a following thermally developable material with a feeding time interval not shoter than the shortest time interval Tmin after coveying out a previous thermally developable material.

Since the feeding means feeds the thermally developable material to the drum with the feeding time interval not shorter than the shortest time interval Tmin, the feeding means can define the shortest time interval Tmin at the conveying direction changing section without providing a timer and the degree of freedom in the feeding path increases. If the degree of freedom in the feeding path increases, it becomes possible to make the size of the apparatus smaller, to make an operator to handle the thermally developable material more easily, and to make an operator to take a counter measure for jamming trouble more easily.

(7) In the thermal development apparatus described in (5), the feeding means feeds thermally developable materials different size in length in terms of the rotation direction of the drum to the drum, the diameter D of the outer circumference of the drum and the maximum length Lmax of a thermally developable material in terms of the rotation direction of the drum among the thermally developable materials fed by the feeding means satisfy formula 6. formula 6:

$$\pi \times D < 2 \times Lmax$$

($\pi$ is the circular constant)

When the feeding means feeds thermally developable materials different size in length in terms of the rotation direction of the drum to the drum, if the diameter D of the outer circumference of the drum and the maximum length L max of a thermally developable material in terms of the rotation direction of the drum among the thermally developable materials fed by the feeding means satisfy formula 6, density irregularities taking place on the center of the image surface of the developed thermally developable material can be refrained and the image quality can be made excellent.

As the feeding means for feeding the thermally developable materials different size in length in terms of the rotation direction of the drum to the drum, for example, a feeding device capable of feeding thermally developable materials from both of a first case in which thermally developable materials of a first size are stored and a second case in which thermally developable materials of a second size defferent in length in terms of the rotation direction of the drum from the first size are stored, may be used. However, the feeding means is not limited to such the feeding device.

(8) In the thermal development apparatus described in (7), the diameter D of the outer circumference of the drum holding a thermally developable material and the minimum length Lmin of a thermally developable material in terms of the rotation direction of the drum among the thermally developable materials fed by the feeding means satisfy formula 7. formula 7:

$$Lmin < \pi \times D$$

($\pi$ is the circular constant)

By making the diameter of the drum large in accordance with the minimum length Lmin of a thermally developable material in terms of the rotation direction of the drum, the curl formation of the thermally developable material can be refrained and the heat capacity of the drum can be made larger than a predetermined value. Accordingly, the temperature drop all over the drum can be minimized and the occurrence of density irregularities can be refrained.

(9) In the thermal development apparatus described in (2), the drum heats a thermally developable material with a developing temperature not lower than 80° C. during a predetermined thermal developing time period.

In the thermal development to develop by the developing temperature not lower than 80° C., density irregularities tends to take place due to a small temperature difference caused by the thermal development in which thermally developable materials are fed to the same position on the outer circumferential surface of the drum. However, since a time period TR during which the drum rotates once and the shortest time interval Tmin to feed the leading end of a thermally developable material onto the drum satisfy formula 1 interms of arbitrary natural numeral N, thermally developable materials are not fed to the same position on the outer circumferential surface of the drum. As a result, the occurence of the density irregularities can be refrained and an image quality can be made excellent.

Incidentally, in the case that the thermally developable material containing silver halide light sensitive particles, organic silver salt, and silver ion deoxidizing agents is thermally developed with a temperature not lower than the lowest developing temperature not lower than 80° C., strong density irregularities take place even though temperature difference is very small. However, since a time period TR during which the drum rotates once and the shortest time interval Tmin to feed the leading end of a thermally developable material onto the drum satisfy formula 1 interms of arbitrary natural numeral N, thermally developable materials are not fed to the same position on the outer circumferential surface of the drum. As a result, the occurence of the density irregularities can be refrained and an image quality can be made excellent. Further, since the light sensitivity of the thermally developable material is vey high, an exposing speed can be increased. As a result, an image formation can be made with a high productivity.

(10) In the thermal development apparatus described in (9), the drum is provided with a plurality of rollers which are rotatable and held onto the drum, the thermally developable materials are held on the outer circumferential surface of the drum by the plurality of rollers, the shortest time interval Tmin is not longer than 27 seconds, at least a first roller firstly coming in contact with the thermally developable material among the plurality of rollers is a solid roller.

By the rotatable rollers held onto the drum, the thermally developable material can be held on the outer circumferential surface of the drum in a manner that the thermally developable material is brought in press contact with the outer circumferential surface of the drum. In this case, if the shortest time interval Tmin is not longer than 27 seconds and a fist roller firstly coming in contact with the thermally developable material among the plurality of rollers is a hollow roller, the temperature of the roller is abruptly dropped. Accordingly, the temperature difference between the leading edge and the trailing edge of the thermally developable material takes place and density irregularities occur. However, if a fist roller firstly coming in contact with the thermally developable material among the plurality of rollers is a solid roller, the temperature difference can be refrained and unevenness in temperature caused by the synchronization between the rotation cycle of the drum and the feeding interval of the thermally developable materials can be refrained. Further, with the synergism by these effects, density irregularities can be refrained more preferably.

(11) In the thermal development apparatus described in (9), the drum is provided with a guide member held onto the drum so as to hold the thermally developable materials on the outer circumferential surface of the drum, an elastic layer having a thickness of 0.0001 (m) or more on the outer circumferential surface of the drum and a supporting member made of a metal to support the elastic layer directly or indirectly.

Since the drum is provided with the metallic supporting member, its rigidity is high and high production precision can be made easily. Since the drum is provided an elastic layer on its outer circumferential surface, the close contactness between the drum and the thermally developable material can be enhanced and density irregularities due to poor contact can be refrained. Further, if the thickness of the elastic layer is not larger 0.002 (m), unstability in heating the thermally developable material due to excessive elastic deformation can be prevented and it may be preferable from the view point of that heat is transmitted from the metallic supporting member to the surface of the elastic layer.

(12) In the thermal development apparatus described in (11), the shortest time interval Tmin is not longer 27 seconds, the thickness of the elastic layer is not thicker than 0.0007 (m), and a ratio of a thermal conductivity (W/m/K) to the thickness of the elastic layer is not larger than 500 ($W/m^2/K$).

In the case that the shortest time interval Tmin is not longer than 27 seconds, the temperature on the surface of the elastic layer is greatly dropped only by developing a single sheet of the thermally developable material. However, if the elastic layer satisfies the above condition of the thickness and the thermal conductivity, the heat is transmitted very well from the metallic supporting member to the surface of the elastic layer. Accordingly, the temperature drop on the surface of the elastic layer can be refrained and unevenness in temperature caused by the synchronization between the rotation cycle of the drum and the feeding interval of the thermally developable materials can be refrained. Further, with the synergism by these effects, density irregularities can be refrained more preferably. Further, from the view point to prevent temperature unevenness in the elastic layer, it may be preferable that a thermal conductivity of the elastic layer is not smaller than 0.4 (W/m/K).

(13) In the thermal development apparatus described in (11), the shortest time interval Tmin is not longer 27 seconds, and the shortest time interval Tmin and the time period TR required for one rotation of the drum satisfy the following formula 8 or 9.

formula 8:

$$19/20 \times TR \geqq Tmin \geqq 21/40 \times TR$$

formula 9:

$$26/20 \times TR \geqq Tmin \geqq 21/40 \times TR$$

In the case that the shortest time interval Tmin is not longer than 27 seconds, the temperature on the surface of the elastic layer is greatly dropped only by developing a single sheet of the thermally developable material. However, since the time period TR required for one rotation of the drum is relatively longer than the shortest time interval to feed the leading end of the thermally developable material onto the drum, the temperature on the surface of the elastic layer dropped only by developing a single sheet of the thermally developable material tends to restore easily and unevenness in temperature caused by the synchronization between the rotation cycle of the drum and the feeding interval of the thermally developable materials can be refrained. Further, with the synergism by these effects, density irregularities can be refrained more preferably.

(14) In the thermal development apparatus described in (13), the shortest time interval Tmin and the time period TR required for one rotation of the drum satisfy the following formula 10.

formula 10:

$$19/20 \times TR \geqq Tmin \geqq 21/40 \times TR$$

Since the time period TR required for one rotation of the drum is relatively longer than the shortest time interval to feed the leading end of the thermally developable material onto the drum, temperature unevenness tends to restore easily. Accordingly, cumulative temperature unevenness becomes small and unevenness in temperature caused by the synchronization between the rotation cycle of the drum and the feeding interval of the thermally developable materials can be refrained. Further, with the synergism by these effects, density irregularities can be refrained more preferably.

(15) In the thermal development apparatus described in (11), a temperature sensor and a flat heater are provided in close contact with each other on the inner circumference of the metallic supporting member, heating by the heater is controlled in accordance with a temperature detected by the temperature sensor, and a control target temperature at the timing to feed the thermally developable materials onto the surface of the drum is higher than that at the other timing.

A temperature difference due to a difference between the position of the temperature sensor and the surface of the elastic layer at the timing to heat the thermally developable materials is larger than that at the other timing. However, by setting the control target temperature at the timing to heat the thermally developable materials higher than that at the other timing, temperature unevenness due to its bad influence can be refrained and unevenness in temperature caused by the synchronization between the rotation cycle of the drum and the feeding interval of the thermally developable materials can be refrained. Further, with the synergism by these effects, density irregularities can be refrained more preferably.

(16) In the thermal development apparatus described in (11), the temperature sensor and the flat heater are provided in close contact with each other on each of plural regions on the inner circumference of the metallic supporting member divided in the conveying direction of an axis of the drum, and assuming that a control target temperature of a heater located at a region on which the thermally developable materials do not pass is Te11 at the timing to heat the thermally developable materials and Te12 at the other timing and a control target temperature of a heater located at a region on which the thermally developable materials pass is Te21 at the timing to heat the thermally developable materials and Te22 at the other timing, Te11, Tel12, Te21 and Te22 satisfy formula 11.

formula 11:

$$Te11 - Te12 < Te12 - Te22$$

There is temperature unevenness on the drum in the conveying direction that a temperature difference due to a difference between the position of the temperature sensor and the surface of the elastic layer at the timing to heat the thermally developable materials is larger on the region on which the thermally developable materials pass than that at the other timing and is small on the region on which the thermally developable materials do not pass. However, by satisfying formula 11, temperature unevenness due to their bad influences can be refrained and unevenness in temperature caused by the synchronization between the rotation cycle of the drum and the feeding interval of the thermally developable materials can be refrained. Further, with the synergism by these effects, density irregularities can be refrained more preferably.

(17) In the thermal development apparatus described in (15) or (16), a lamp processing is conducted at the control of the heating by the heater.

Since the control of the heating by the heater is smoothed by the lamp processing, occurrence of temperature unevenness due to a sudden change in the heating control can be refrained and the density irregularities due to this can be refrained and the density irregularities due to this can be refrained. The lamp processing means a processing with which temperature is controlled not to change suddenly in terms of time and to change gradually. As an example of the lamp processing, in the case that the control target temperature is changed discontinuously in terms of time, there is a method to make it change continuously. However, the lamp processing is not limited to this method.

(18) In a method of using a thermal development apparatus which comprises a drum to heat a thermally developable material on its outer circumferential surface while rotating at a predetermined rotation speed and a feeding means which feeds a sheet-like thermally developable material onto the outer circumferential surface of the drum, and thermally develop the thermally developable material fed by the feeding means by heating it to a thermally developing temperature not lower than 80° C. while holding it on the outer circumferential surface of the drum;

feeding a sheet-like thermally developable material containing silver halide light sensitive particles, organic silver salt, and silver ion deoxidizing agents onto the outer circumferential surface of the drum, wherein the lowest thermally developing temperature of the thermally developable material is not lower than 80° C.; and heating so as to thermally develop the thermally developable material while holding it on the outer circumferential surface of the drum;

an existing ratio of natural number n which satisfy all formula 3 to 5 described below is at least 50 percent;

formula 3

$$(N-1/20)\times TR \geqq T(n)$$

or $$(N+1/20)\times TR \leqq T(n),$$

formula 4

$$(N-1/20)\times TR \geqq T(n+1)$$

or $$(N+1/20)\times TR \leqq T(n+1),$$

formula 5

$$(N-1/20)\times TR \geqq T(n)+T(n+1)$$

or $$(N+1/20)\times TR \leqq T(n)+T(n+1)$$

wherein TR denotes the time required for one rotation of the drum, T(n) denotes the interval between the time when the leading edge of a sheet of thermally developable material is fed to the drum in the n-th place and the time when the leading edge of the following sheet of thermally developable material is fed to the same in the (n-th+1) place, and N denotes an arbitrary natural number.

In the thermally developable material containing silver halide light sensitive particles, organic silver salt, and silver ion deoxidizing agents which is not substantially thermally developed with the temperature not higher than 40° C. and is thermally developed with the lowest thermally developing temperature not lower than 80° C., density is appreciably changed due to the temperature difference (for example ±0.5° C.) of the organic silver salt layer, deferring from an ordinal thermally developable material. However, since an existing ratio of natural number n which satisfy all formula 3 to 5 described below is 50 percent or more, the probability that the leading end of the thermally developable material is continuously fed to the substantially same position on the drum becomes low, unevenness in temperature in terms of the rotation direction of the drum hardly occurs. As a result, the unevenness in temperature can be efficiently prevented.

Incidentally, the existing ratio of the natural number n which satisfies the above formulas may be obtained in such a manner that each time when during develop-processing the number of M sheets of thermally developable materials, the leading edge portions of these sheets of thermally developable materials are fed onto the drum is recorded, and the percentage of the natural number n which satisfies the above formula is obtained employing time TR for one rotation of the drum, however the method obtaining the number is not limited to this. Furthermore, from the viewpoint of effective minimization of the uneven density, the existing ratio of natural numbers which satisfy the above formulas are preferably at least 70 percent (and more preferably at least 90 percent). Although, the number of M is 100 sheets in the example, it may be preferable that the number of M is 100 sheets or more.

Further, the above objects may be attained by the following preferable structures and methods.

(19) In a thermal development apparatus provided with a feeding means for feeding a sheet-like thermally developable material and a drum to heat a sheet of thermally developable material fed from the feeding means while holding the sheet of thermally developable material against the outer circumferential surface and rotating at a substantially constant speed, the thermally developable material is fed to the drum in such a timing that the feeding means shifts in the rotational direction of the drum a position at which a leading edge of the sheet of the thermally developable material is held on the drum at least among sheets of the thermally developable materials which are heated continually by the drum.

(20) The thermal development apparatus of claim 19, wherein the thermally developable materials having plurality of different lengths along the rotational direction of said drum are developed.

(21) The thermal development apparatus of claim 20, wherein a diameter D of the outer circumferential surface circle of the drum holding the sheet of thermally developable material and a minimum length Lmin in the rotational direction of the sheet of thermally developable material satisfy the following formula.

$$Lmin<\pi\times D$$

($\pi$ is the circular constant)

(22) The thermal development apparatus of claim 21, wherein a diameter D of the outer circumferential surface circle of the drum holding the sheet of thermally developable material and a maximum length Lmax in the rotational direction of the sheet of thermally developable material satisfy the following formula.

$$\pi \times D < 2 \times Lmax$$

($\pi$ is the circular constant)

(23) The thermal development apparatus of claim 19, wherein the thermally developable material contains silver halide light sensitive particles, an organic silver salt, and a silver ion reducing agent, is not substantially thermally developed with a temperature not high than 40° C., and is thermally developed with a temperature not lower than a lowest thermally developing temperature not lower than 80° C.

(24) The thermal development apparatus of claim 23, wherein the drum heats the thermally developable material with a development temperature higher than a lowest development temperature during a thermal development time period.

(25) The thermal development apparatus of claim 19, further comprising a roller which is rotatable and pressed onto the drum.

(26) The thermal development apparatus of claim 25, further comprising an elastic layer having a thickness of 0.1 mm or more.

(27) The thermal development apparatus of claim 26, wherein the elastic layer has a thickness not thicker than 2 mm and a thermal conductivity of 0.4 (W/m·k), and the drum comprises a metallic supporting member to support the elastic layer directly indirectly.

(28) In a thermal development apparatus provided with a feeding means for feeding a sheet-like thermally developable material and a drum to heat a sheet of thermally developable material fed from the feeding means while holding the sheet of thermally developable material against the outer circumferential surface and rotating at a substantially constant speed, a time period TR required for one rotation of the drum and a time interval T between a time when the leading edge of the sheet of thermally developable material is fed to the drum and a time when that of the following one is fed to the drum satisfy the formula described below;

$$T \neq N \times TR$$

wherein N denotes an arbitrary natural number.

(29) The thermal development apparatus of claim 28, wherein the time period TR and the time interval T satisfy the following formula;

$$(N-1/20) \times TR \geqq T$$

or $$(N+1/20) \times TR \leqq T$$

wherein N denotes an arbitrary natural number.

(30) In a thermal development apparatus provided with a feeding means for feeding a sheet-like thermally developable material and a drum to heat a sheet of thermally developable material fed from the feeding means while holding the sheet of thermally developable material against the outer circumferential surface and rotating at a substantially constant speed, an existing ratio of natural numbers which satisfy all formulas described below is 50 percent or more;

$$(N-1/20) \times TR \geqq T(n)$$

or $$(N+1/20) \times TR \leqq T(n),$$

and $$(N-1/20) \times TR \geqq T(n+1)$$

or $$(N+1/20) \times TR \leqq T(n+1),$$

and $$(N-1/20) \times TR \geqq T(n)+T(n+1)$$

or $$(N+1/20) \times TR \leqq T(n)+T(n+1)$$

wherein TR represents a time period required for one rotation of the drum and T(n) represents a time interval between a time when the leading edge of the sheet of thermally developable material fed at n-th order is fed to the drum and a time when that of the sheet of thermally developable material fed at (n+1)-th order is fed to the drum, and N denotes an arbitrary natural number.

(31) In a thermal development apparatus provided with a feeding means for feeding a sheet-like thermally developable material and a drum to heat a sheet of thermally developable material fed from the feeding means while holding the sheet of thermally developable material against the outer circumferential surface and rotating at a substantially constant speed, the thermally developable materials having plurality of different lengths along the rotational direction of said drum are developed, and a diameter D of the outer circumferential surface circle of the drum holding the sheet of thermally developable material and a minimum length Lmin in the rotational direction of the sheet of thermally developable material satisfy the following formula.

$$Lmin < \pi \times D$$

($\pi$ is the circular constant)

(32) A thermal development method, comprising steps of:

rotating a drum whose outer circumferential surface is heated at a substantially constant rotational speed;

feeding a first sheet of thermal developable material onto the outer circumferential surface of the drum;

holding the fed first sheet of thermally developable material onto the outer circumferential surface of the drum over a predetermined time period;

removing the first sheet of thermally developable material from the outer circumference of the drum; and feeding a second sheet of thermally developable material onto the outer circumferential surface of the drum while shifting a position of a leading edge of the second sheet of thermally developable material following the first sheet of thermally developable material in the rotational direction of the drum with respect to the position on the outer circumferential surface of the drum at which the leading edge of the first sheet of thermally developable material is held.

DETAILED DESCRIPTION OF THE PREFERRED EMBODIMENT

Figure 1:
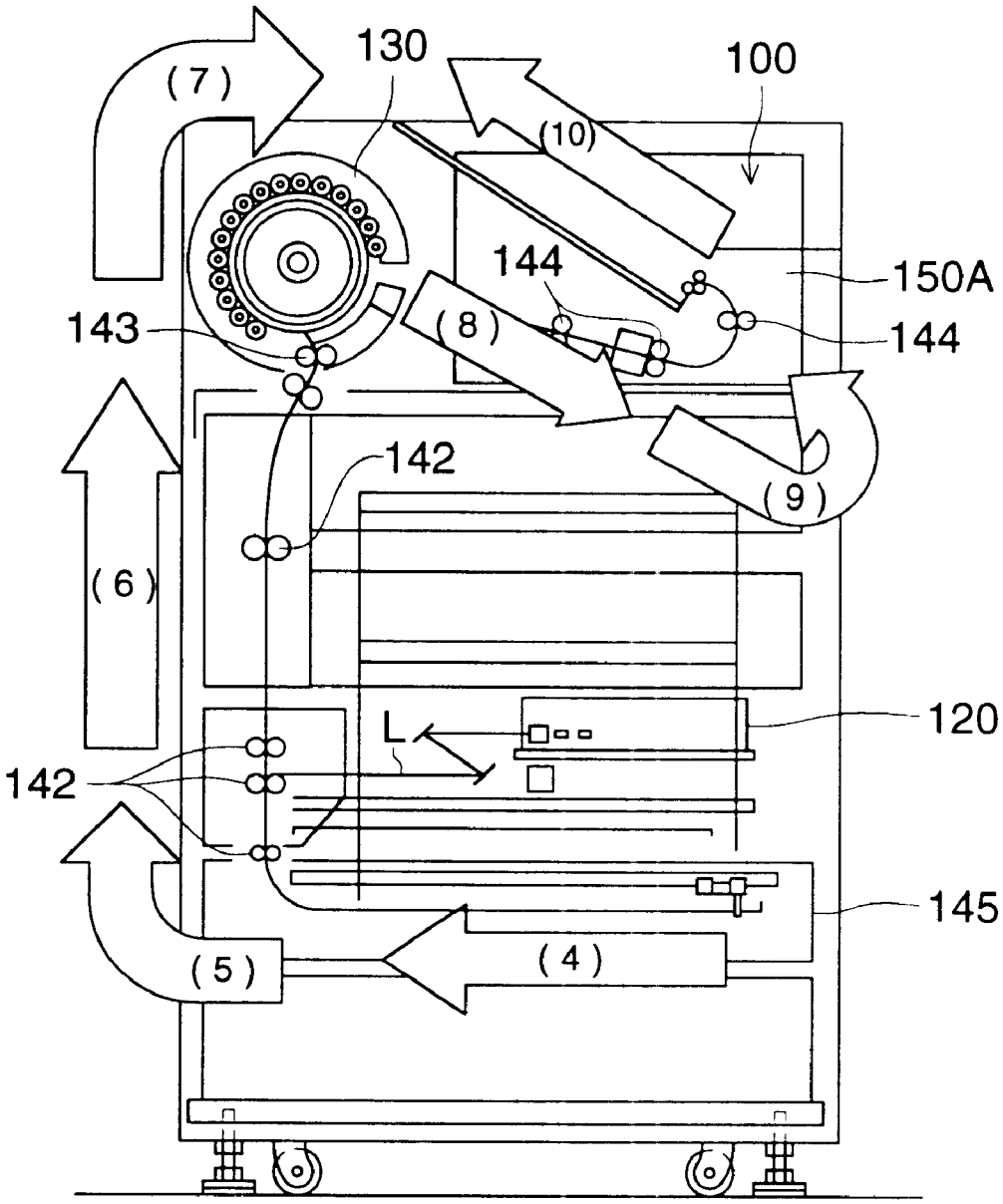
FIG. 1 is a front view of the thermal development apparatus according to the embodiment of the present invention.

Described in the following are the embodiment which is one example of the present invention and examples thereof. Accordingly, it should be understood that the meaning of terms in the invention and the invention itself are not limited to the description in the embodiment of the invention and the examples, and it should be further understood that appropriate variations/improvements can be effected within the spirit and scope of the present invention. FIG. 2 is a left side view of such a thermal development apparatus. Thermal development apparatus 100 comprises housing section 110 in which sheets of film F, which are those of thermally developable materials shown in Examples are placed, exposure section 120 which exposes sheets of film F which are fed and conveyed individually from the housing section 110 and are conveyed, and development section 130 which develops the exposed sheets of film F. The operation of the thermal development apparatus 100 will now be described with reference to FIGS. 1 and 2.

In FIG. 2, the housing section 110 is composed of an upper section and a lower section, and case C in which sheets of film F are placed is housed as it is. Sheets of film F are fed from the case C employing a feeding device (not shown), and are pulled out in the horizontal direction as shown by arrow (1) in FIG. 1. Further, the sheet of film F pulled out from the case C is conveyed downward, as shown by arrow (2) in FIG. 1.

Further, by placing sheets of film F, having different lengths in the conveying directions on the drum 14 described below, into each of the two-leveled cases C, and by placing sheets of film F, having different lengths in the conveying directions in the case C, into each of the two-leveled cases C, needless to say, a plurality of sheets of film F having different lengths in the conveying directions may be thermally developed on the drum 14.

Figure 2:
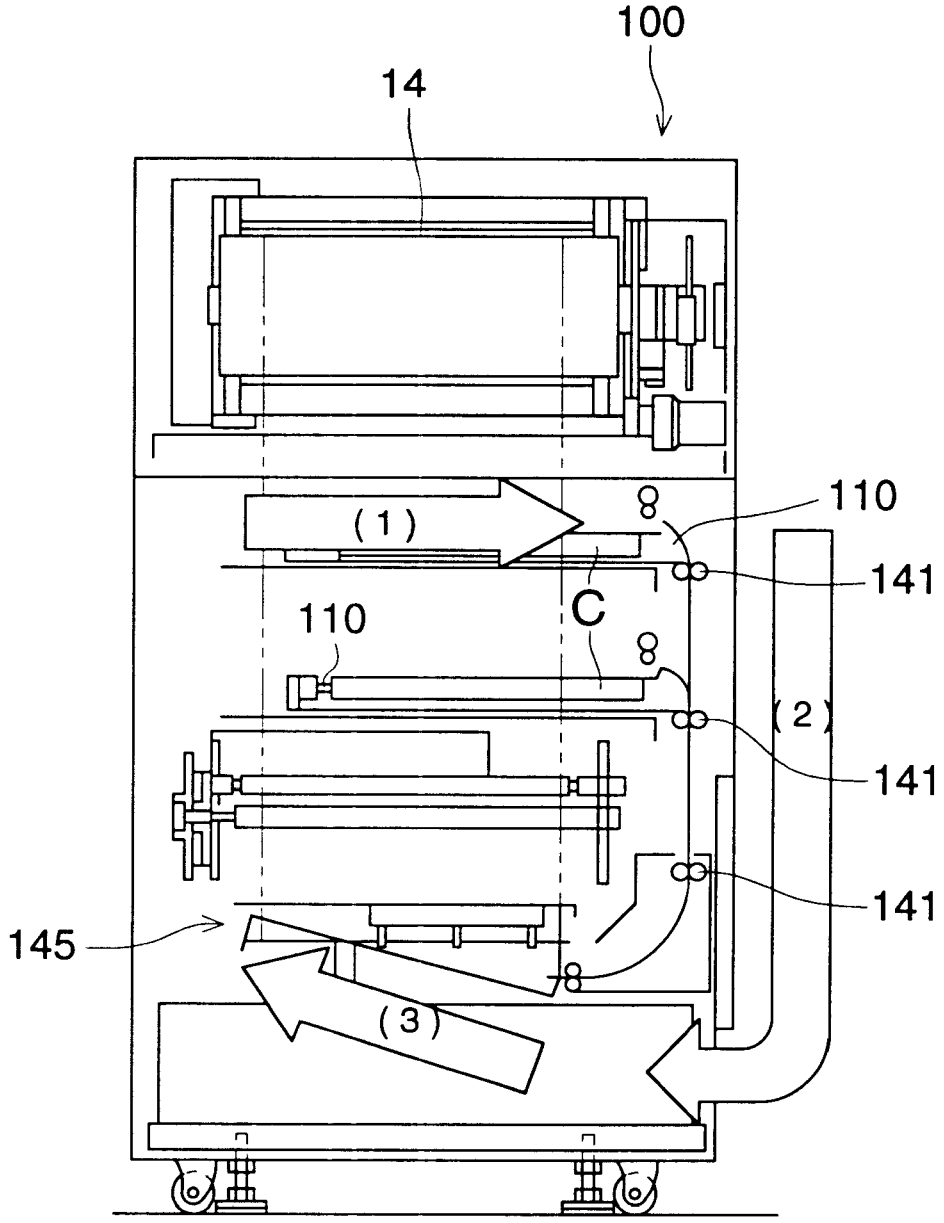
FIG. 2 is a left side view of the thermal development apparatus according to the embodiment of the present invention.

Sheet of film F is conveyed downward in the thermal development apparatus 100; is further conveyed to conveying direction altering section 145 which is installed in the lower part of the thermal development apparatus 100; is subjected to alteration of the conveying direction (arrow (3) in FIG. 2 and arrow (4) in FIG. 1) at the conveying direction altering section 145; and is subjected to shift to exposure preparatory stage. Further, sheet of film F is conveyed in the upward direction as shown by arrow (5) in FIG. 1, employing conveying device 142 comprised of pairs of rollers, and during that time, is subjected to scanning exposure employing laser beam L, being within the infrared range of 810 to 780 nm.

Sheet of film F, which is subjected to exposure of laser beam L forms a latent image in the constitution as described later. Thereafter, the resulting sheet of film F is conveyed in the upward direction as shown by arrow (6) in FIG. 1, and when reaching paired rollers 143, it is subsequently fed onto the drum 14, that is, it is fed at random timing, or when reaching the paired rollers 143, it may be stopped.

Further, while the drum 14 is holding a sheet of film F on the circumference thereof, it rotates with the film F at a predetermined constant rotation speed in the direction as shown by arrow (7) in FIG. 1. In such a state, the sheet of film 14 is heated by the drum 14 to result in thermal development, and a visible image is formed from the latent image in the constitution as described later. Thereafter, when the drum 14 rotates until the right direction in FIG. 1, the sheet of film F is detached from the drum 14, is conveyed in the direction shown by arrow (8) in FIG. 1, and is then cooled. The resulting sheet of film F is then conveyed in the direction shown by arrows (9) and (10) in FIG. 1, employing conveying device 144, and is ejected so that it can be picked up from the upper part of the thermal development apparatus 100.

Figure 3:
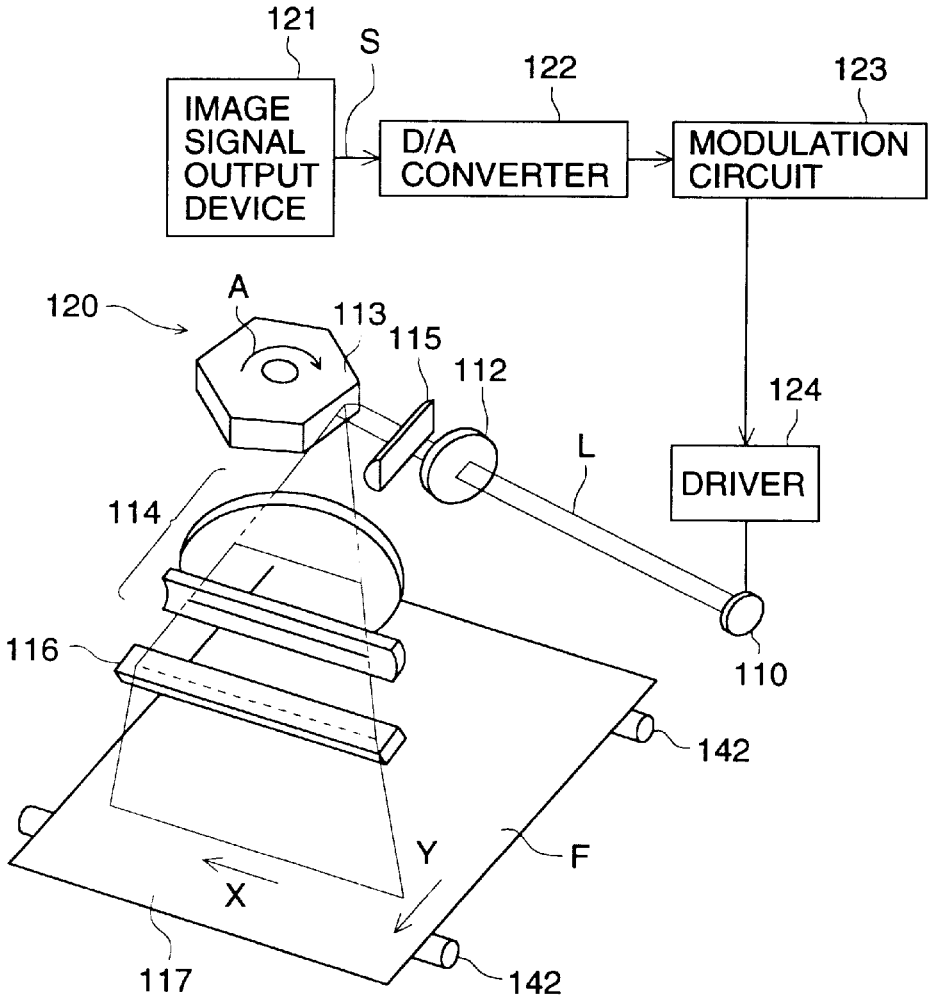
FIG. 3 is a schematic view showing the structure of exposure section 120.

FIG. 3 is a schematic view showing the constitution of exposure section 120. In the exposure section 120, the film F is subjected to primary scanning, employing laser beam L subjected to intensity modulation based on image signals S, which is deflected by rotational polygonal mirror 113, and at the same time, it is subjected to secondary scanning by carrying out relative movement at an approximately right angle, with respect to the primary scanning direction, to form a latent image on the film F.

A more specific constitution will be described below. In FIG. 3, image signals S which are digital signals outputted from image signal output device 121 are converted into analogue signals employing D/A converter 122 and are inputted into modulation circuit 123. The modulation circuit 123 is constituted in such a manner that it controls driver 124 of semiconductor laser 110 based on such analogue signals so that modulated laser beam L is emitted from the semiconductor laser 110.

Laser beam L emitted from the semiconductor laser 110 is converged only in the upward and downward directions employing cylindrical lens 115, and is utilized as an incident beam so as to form a line image perpendicular to the driving axis with respect to rotational polygonal mirror 113 which rotates in the direction shown by arrow A in FIG. 3. Laser beam L is subjected to reflection-deflection in the primary scanning direction employing the rotational polygonal mirror 113, and the deflected laser beam L passes through fθ lens 114 comprising a cylindrical lens composed of two combined lenses. Thereafter, the resulting laser beam L is reflected by mirror 116 which is provided in the beam path being extended in the primary scanning direction, and is employed so that the scanning surface of the film F (subjected to the secondary scanning), which is being conveyed in the arrow Y direction by the conveying device 142, is subjected to repeated primary scanning in the arrow X direction. Namely, the entire surface of the film F to be scanned is subjected to scanning employing the laser beam L.

Incident laser beam L converges onto the scanning surface of the film F only in the secondary scanning direction employing the cylindrical lens of fθ lens 114, and the distance between the fθ lens 114 and the scanning surface is the same as the focal length of the entire fθ lens 114. In such a manner, the present exposure section 120 is provided with the fθ lens 114 comprising a cylindrical lens as well as mirror 116, and the laser beam L temporarily converges in the secondary scanning direction onto the rotational polygonal mirror 113. As a result, even though surface decline and axis deviation occur on the scanning surface of the film F, the scanning position of the laser beam L does not deviate in the secondary scanning direction so that equally pitched scanning lines are drawn. The rotational polygonal mirror 113 is excellent in scanning stability compared to, for example, other light deflecting devices such as a galvanometer mirror, and the like. Further, as described above, a latent image is formed on the film F based on image signals S. Incidentally, the specific chemical reactions, which form a latent image, will be described later, with reference to FIG. 7.

Figure 4:
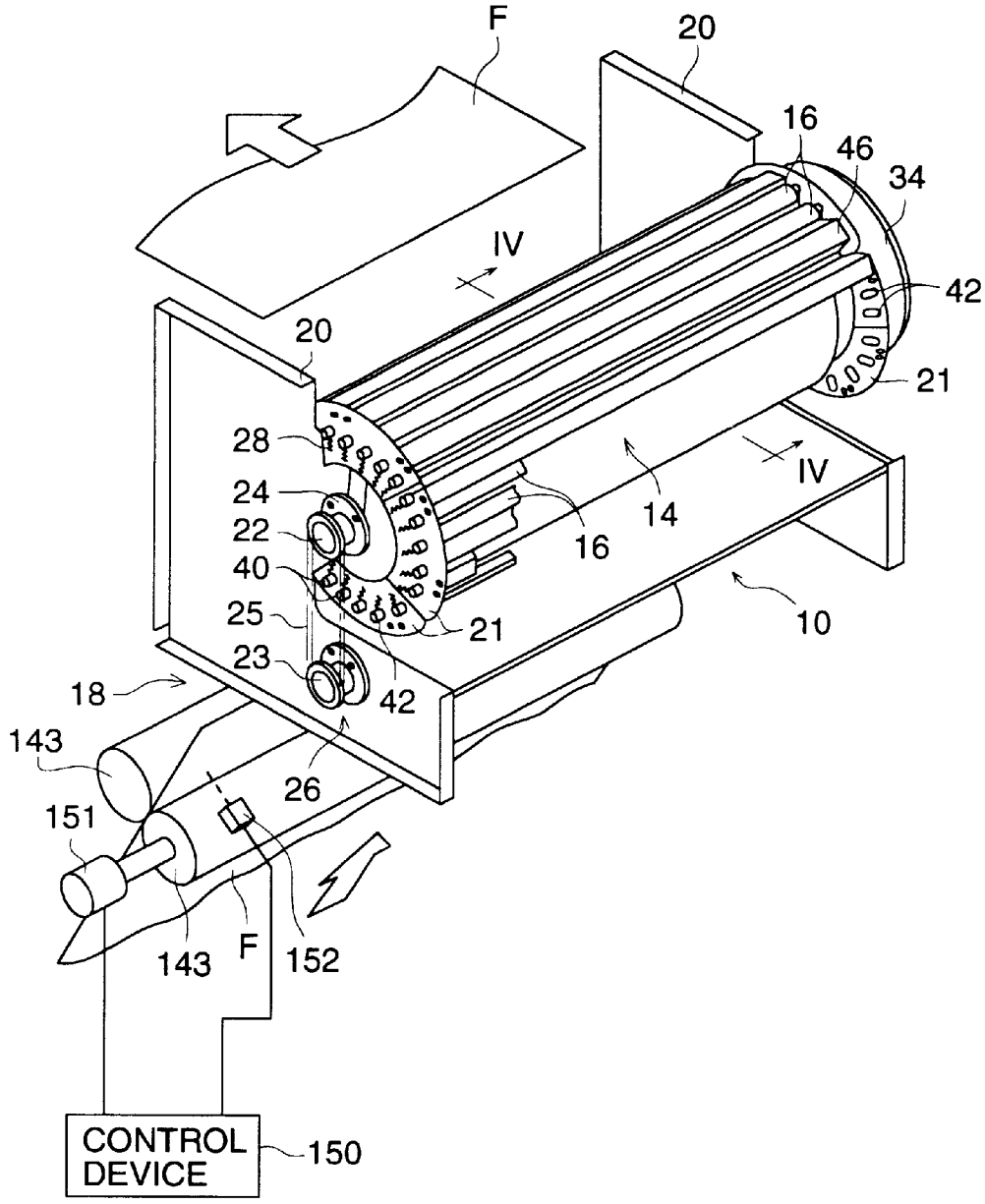
FIG. 4 is a view showing the structure of development section 130 which heats film F, and a perspective view of development section 130.
Figure 5:
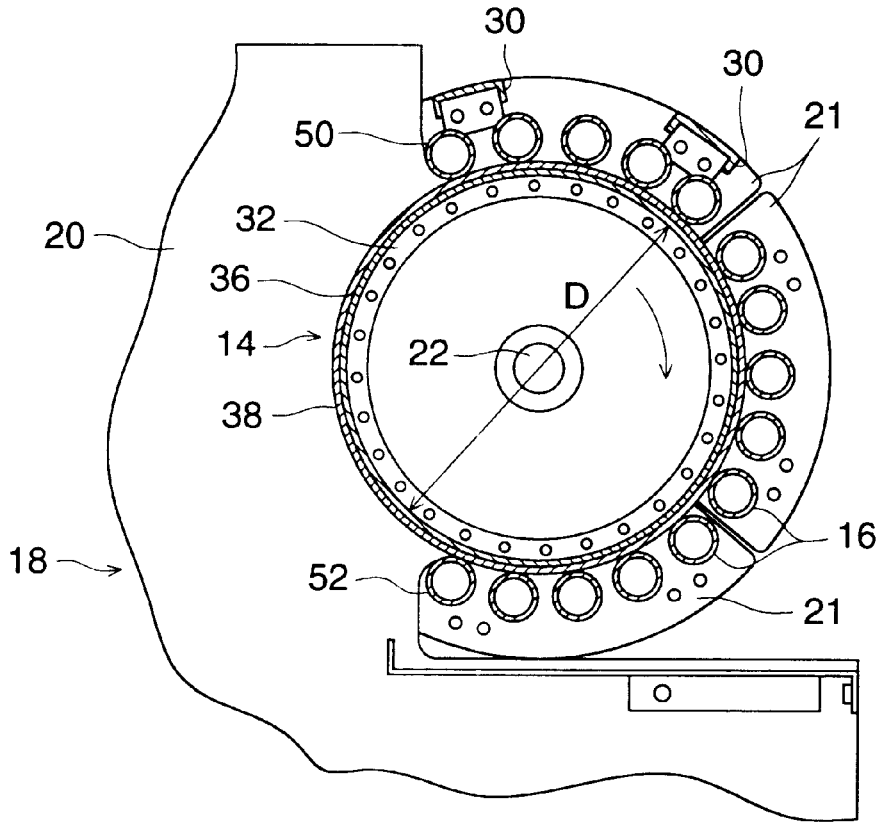
FIG. 5 is a cross-sectional view taken along line IV—IV of the structure in FIG. 4.
Figure 6:
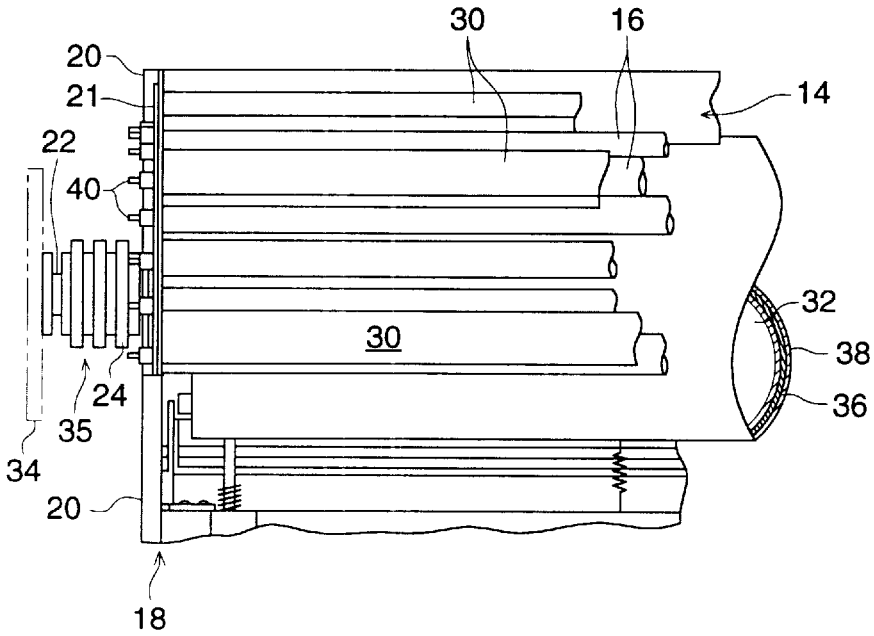
FIG. 6 is a front view of the structure of FIG. 4.

FIGS. 4 through 7 are views showing the constitution of the development section 130, which heats the film F. FIG. 4, is a perspective view of the development section 140, while FIG. 5 is a cross-sectional view taken along line IV—IV in the constitution illustrated in FIG. 4, while FIG. 6 is a front view of the constitution illustrated in FIG. 4.

The development section 130 comprises the drum 14 to heat the film F on its circumferential surface while rotating at a constant rotation speed. The drum 14 exhibits a function to convert a latent image formed on the film F into a visible image by maintaining the film F at the lowest thermal development temperature while holding the film F on the circumferential surface of the drum, or higher, for a specified thermal development time. The lowest thermal development temperature as described herein means the lowest temperature, at which a latent image formed on the film F is subjected to initiation of thermal development, and for the sheet of film in the present embodiment, it is 115° C. to 120° C. On the other hand, the thermal development time as described herein means the time for which the lowest thermal development temperature, or higher, is maintained in order to develop the latent image on the film F so as to obtain desired development characteristics.

Further, in the present embodiment, the development section 130 is built in thermal development apparatus 100 together with exposure section 120, however the exposure section 120 may be an independent device. In such a case, a conveyance section is needed to convey sheets of film F from the exposure section to the development section.

In the exterior of the drum 14, 15 small diameter rollers 16 are provided as guide members. The rollers are arranged parallel to the axis of the drum 14 and at equal intervals in the circumferential direction of the drum 14. At both ends of the drum 14, three guide brackets 21 supported by frame 18 are provided at each end. Further, by employing the guide brackets 21 in combination, a reversed "C" letter shape is formed at both ends of the drum 14.

In each guide bracket 21, 5 long holes extended in the radius direction are formed. Shafts 40, provided at both ends of roller 16, are projected through the long holes 42. Each shaft 40 is attached to one end of coil spring 28, and the other end of the coil spring 28 is attached to the area adjacent to the interior end of the guide bracket 21. Accordingly, each roller 16 is held against the outer circumference of the drum 14 with a specified force based on the pressing power of the coil spring 28. The sheet of film F, when fed between the outer circumference of the drum 14 and the roller 16, is held onto the outer circumferential surface of the drum 14 at a specified force and the entire film F is uniformly heated thereby.

Axial shaft 22 connected to the drum 14 extends beyond the end member 20 of frame 18, and is rotatably supported against the end member employing shaft bearing 24. A gear (not shown) is formed on the rotational axis 23 of the micro-step motor (not shown) which is arranged below the shaft 22 and is affixed to the end member 20. On the other hand, the gear is also formed on the shaft 22. The driving force of the micro-step motor is transmitted to the shaft 22 via the chain connecting both gears or a timing belt (a toothed belt) 25, and the drum 14 rotates thereby. Further, power transmission from the rotational axis to the shaft 22 may also be carried out via series of gears.

As shown in FIG. 5, in the present embodiment, rollers 16 are provided in the range of about 220 degrees in the circumferential direction. It is designed so that two reinforcing members 30 (shown in FIG. 5) connect both end members 20 of the frame 18 and additionally support both end members 20.

Plate-shaped heaters 32 are attached onto the entire interior circumference of the drum 14 so that the outer circumference of the drum 14 is heated under the control of electronic control device 34, shown in FIG. 6. Electric power is fed to heater 32 via slip ring assembly 35 connected to the electronic control device 34.

Further, in the present embodiment, in order to make the thermal development apparatus 100 more compact, the drum 14 is shaped as a rotatable cylinder, however other constitutions may be employed as a means to heat sheets of film F. For example, the film F may be placed onto a belt conveyer equipped with heaters and may be heated while the film F is being conveyed employing such a belt conveyer.

As FIG. 5 shows, the drum 14 is provided with supporting aluminum tube 36 which is a metallic supporting member and flexible layer (an elastic layer) 38 which is formed on the outside of the supporting tube 36. Further, the flexible tube 38 may be indirectly attached to the supporting tube 36. The length and wall thickness of the supporting tube 36 according to the present embodiment are 45.7 cm and 0.64 cm, respectively, while the exterior diameter is 16 cm. However, it is possible to arbitrarily alter the diameter of the supporting tube 36 within the range satisfying the above-mentioned formula 7. For instance, the wall thickness of the metal holding tube of the drum 14 is preferably at least 0.70 cm, based on the following facts. Namely, the accumulating effect of uneven temperature in both the conveying direction and the conveying width direction of the drum 14 becomes small. Thus in conjunction with the effect of the present invention in which a fed position is shifted in the conveying direction, the uneven temperature is markedly minimized so that uneven density is hardly recognized. However, when the wall thickness exceeds 2.0 cm, during successive feeding of sheets of film F, the generation of uneven temperature is not great while the fed position in the conveying direction is not varied. However, the production cost markedly increases and the heat capacity of the drum 14 becomes excessively large. As a result, a large amount of heat is required for variation from the initial sate to that capable of thermal development, and further, the temperature control becomes difficult. Accordingly, the wall thickens is preferably no more than 2.0 cm.

On the other hand, unevenness of the thickness of the supporting tube is preferably controlled to be within 4 percent. Further, in order to enhance close contact with the film F which is to be heated, the flexible layer 38 is constituted so as to have a sufficiently smooth surface, and the surface roughness Ra is preferably no more than 6.3 $\mu$m (and more preferably, no more than 3.2 $\mu$m).

However, in order to minimize adhesion of the film F onto the drum 14, the surface roughness Ra of the flexible layer 38 comprised of specified materials such as silicone rubber as the base is preferably no less than 0.3 $\mu$m, and is more preferably no less than 2.3 $\mu$m, if possible. Furthermore, when the surface roughness is no less than 2.3 $\mu$m, gases, particularly sublimable materials, are more likely discharged.

The flexible layer 38 has a high thermal conductivity of at least 0.3 W/m/K so that the temperature of the outer circumferential surface of the drum 14 is uniformly maintained. Further, in the present embodiment, the thermal conductivity of the flexible layer 38 is designated to be at least 0.4 W/m/K.

Due to the employment of the flexible layer 38, the film F is securely brought into close contact with the drum 14 employing rollers 16 without degrading the abrasion resistance. The flexible layer preferably has a Shore A hardness of no more than 70 (and more preferably no more than 60), as measured by a durometer. In the present embodiment, the Shore hardness A is designated to be no more than 55 in terms of hardness.

Further, the specified materials comprise additives to enhance thermal conductivity as well as silicone rubber. It is found that such materials are particularly useful to form the flexible layer 38. Though the silicone rubber incorporated into such materials has a relatively small thermal conductivity, the silicone rubber improves contact properties against the film F as well as durability (abrasion resistance).

On the other hand, in order to enhance processing capacity, it is necessary to raise thermal conductivity. The above-mentioned additives contribute to maintain the required high thermal conductivity. However, when the added amount of additives incorporated into the flexible layer 38 increases, contact properties of the silicone rubber, as well as durability is degraded. Therefore, it is necessary that the amount of additives to the silicone rubber is balanced within a certain range. Further, a material containing silicone rubber exhibits advantage of being easily detachable from the film F, and further is chemically inactive.

The thickness of flexible layer 38 is preferably no smaller than 0.1 mm. It is possible to use a flexible layer 38 having a thickness of less than that. However, as the thickness decreases, the function of the flexible layer 30 deteriorates and a problem with inherent production of such a thin layer occurs. Furthermore, the drum 14 comprising a metal holding member exhibits high rigidity, and high accuracy is readily obtained in machining. In addition, since elastic layer 38 having a thickness of at least 0.1 mm is provided on the surface, the close contact of the drum with a sheet of thermally developable material may be enhanced so that the generation of uneven density due to insufficient contact may be minimized. Further, the thickness of the flexible layer 38 is preferably at least 0.4 mm. In addition, the fluctuation of the thickness of the flexible layer 38 is preferably no more than 20 percent on the surface area (is most preferably no more than 10 percent). In the present embodiment, the fluctuation is controlled below 5 percent. Further, the ratio of the thermal conductivity (W/m/k) to the thickness (m) of the flexible layer is preferably at least 50 (W/m$^2$/k) so that the temperature difference between the film F positioned area and any area other than that is small, minimizing the formation of uneven density. Furthermore, the thickness of the flexible layer is preferably no more than 2 mm so that instability in heating a sheet of thermally developable material due to excessive elastic deformation is minimized and from the viewpoint of heating properties of transmitting heat from the metal holding member to the flexible layer surface, and is most preferably no more than 0.7 mm so that the uneven temperature tends not to result and the uneven density also tends not to result.

In the present embodiment, employed as a guide member is rotatable rollers 16. However, it is possible to use other means such as a small movable belt and the like. In the present embodiment, employed as the rollers 16 is an aluminum pipe having an exterior diameter of 2.18 cm and a wall thickness of 1 mm. Hollow rollers 16 minimize heat transmission and due to this, it is possible to minimize the thermal effect of rollers 16 during development.

As described above, the pressing force of coil springs 28 determines that of the rollers 16 so that the film F can be brought into more close contact with the outer circumferential surface of the drum 14 and can be subjected to sufficient heat transmission. Therefore, it is necessary to select the degree of pressure carefully. When the pressing force of the coil spring 28 is too small, image development may not be completed due to the lack of uniform heat transmission. Further, when the pressing force is further smaller, there is a fear that rollers 16 do not rotate along with the drum 14. In such a case, the film F rotates and moves along with the drum 14, and when rollers 16 are in contact with the film F, the film F may be abraded by rollers 16.

On the other hand, it is also necessary to decrease the pressing force of the coil springs 28 so that the rollers 16 do not cause indentation on the film F. Furthermore, when a coil spring 28 is employed for each roller 16, which is provided on the circumference of the cylindrical drum 14, the pressing force provided by each coil spring 28 is preferably determined by taking into account the weight of each roller 16. The entire film F may be subjected to approximately uniform surface pressure so that for example, the pressing force of the coil spring 28 which presses the roller 16 positioned at the top of the drum 14 is decreased in response to the weight of the roller 16 compared to other coil springs 28 at the bottom of the drum 14 which press the rollers 16.

In order to solve or soften the above problems, the pressing force per cm in the widthwise direction of the film F from rollers 16 is preferably in the range of 7.2 to 200 g (more preferably, in the range of 7.2 to 100 g). In the present embodiment, such a force is controlled to be within 14 to 30 g per cm in the widthwise direction of the film F. In addition, the rotation driven sections are provided at both ends of the rollers 16 so that the decrease in indentation can be securely balanced with the decrease in a non-uniform image through maintaining the pressing force in the above-cited range.

In addition to the pressing force generated by each roller 16, it is to be understood that the space between adjacent rollers 16 is important to carry out formation of a high quality image employing the film F. When the film F is fed to the drum 14, generally it is at room temperature (approximately, 20° C.). Accordingly, in order to maximize the processing capacity of the development section 130, the film F should be rapidly heated from the room temperature to the lowest thermal development temperature (in the present invention, at least 115 to 120° C.) necessary for the initiation of thermal development.

However, components, for example, sheet material composed of polyester film as the substrate, sheet materials composed of other thermoplastic material as the substrate, incorporated into a certain type of film F, may thermally expand or contract (shrink) during heating. Accordingly, in order to achieve uniform dimensional change so that wrinkling does not occur, the film F should be uniformly heated while the film F is in alternative state variations between the state in which the film F is maintained in flat and the state in which the film is left freely. In order to allow for such a state, a plurality of rollers 16 are arranged at intervals so that when the film F is not restrained between the rollers 16 and the drum 14, the dimensional variation of the film F positioned between adjacent rollers 16 may occur freely.

However, as described above, the rollers 16 should hold and press the film F against the drum 14 over a predetermined period of time so that heat is sufficiently and uniformly transmitted and the film F is uniformly developed. Accordingly, the space between the adjacent rollers 16 must be such that wrinkling is minimized and the film F is rapidly and uniformly heated.

Further, on the outer circumference of the cylindrical drum 14, the leading edge of the film F is due to its rigidity directed in the tangential direction between the adjacent rollers 16. In order to restrain this tendency, rollers 16 should be positioned to be sufficiently adjacent to each other. Such an arrangement is important in order to maintain the position of the film F between the rollers 16 and the drum 14.

As shown in FIGS. 4 through 6, 15 pieces of rollers 16 are provided in the angle range of 224 degrees, and each space is separated by the angle range of 16 degrees against the center-to-center. When the diameter of the drum 14 is between 8.9 and 20.3 cm and the diameter of the roller is 2.18 cm, this constitution advantageously functions for relatively stiff film F such as a 0.18 mm thick polyester film support, and the like, as well as for less stiff film F such as a 0.10 mm thick polyester film support and the like.

Heater 32 is mounted on the interior circumference of the drum 14 to heat the outer circumferential surface of the drum. Employed as the heater 32 to heat the drum 14 may be an etched resistance foil heater.

Heater controlling electronic device 34 rotates together with the drum 14 and is designed so that electric power fed to the heater 32 is controlled in response to sensed temperature information. The temperature control will be explained later. The exterior surface temperature of the drum 14 may be adjusted to maintain the suitable temperature for the development of predetermined film F. Needless to say, there is provided a temperature sensor in close contact with the inner circumferential surface of the drum in order to detect the temperature. In the present embodiment, the drum 14 can be heated to between 60 and 160° C., employing the heater 32 as well as its electronic control device 34.

Herein, it is preferred to maintain the temperature of the drum 14 across its width, within 2.0° C. (and preferably within 1.0° C.), employing the heater 32 and the electronic control device 34.

Unprocessed film F fed from a pair of supply rollers 143 at predetermined timed feeding is fed into the holding section created by the heating member 14 and the most upstream roller 16 (that is, nip section 52 shown in FIG. 5) in the development section 130. Subsequently, the film F rotates together with the drum 14. At the same time, the film F is held against the drum 14 employing the rollers 16, and during the rotation, is brought into contact with the exterior circumference of the drum 14.

Because the drum 14 can move at a speed approximately similar to that of the film F, the surface of film F is less likely to be abraded or scratched and thereby it is possible to obtain consistently high quality images. The film F is conveyed between the drum 14 and the rollers 16, and thereafter, the developed film F is guided by nip section (that is, nip section 52 shown in FIG. 5) created by the roller 16 positioned most downstream of the drum 14, and is pulled away from the drum 14 into the development section 130.

The development section 130 can be constituted so that various sheets of film F such as, for example, a 0.178 mm thick polyester substrate which is coated with a thermally developable photosensitive emulsion comprising infrared-sensitive silver halides shown in Example and the like are developed. The drum 14 is maintained at 115 to 138° C., for example at 124° C., and the drum 14 is rotated approximately for a predetermined period of time, namely 15 seconds at such a rotation speed so that the film F is held against the outer circumference in a state of contact. During the predetermined time and at the predetermined temperature, the film F can be heated up to 124° C.

The thickness, as well as the thermal conductivity of the flexible layer 38, is selectively determined so that sheets of film F are successively and efficiently processed. Of course, these parameters can be varied in accordance with specified properties (characteristics) of developed sheets of film F as well as desired processing capacity. For example, in order to develop sheets of film F requiring different conditions for processing, the temperature as well as the rotational speed of the drum 14 may be varied in the same manner as the predetermined time during which the film F is in contact with the drum 14.

In addition, in the same manner as for the drum 14, a flexible layer may also be provided on the rollers 16. Furthermore, instead of providing a flexible layer on the rollers 16, a less flexible exterior layer may be provided on the drum 14. Further, it may be designed that the drum 14 is a rotational roller, and a cylindrical drum or a flat endless belt performs the function of the rollers 16.

The surface of the thermally developable photosensitive emulsion layer side of film F is preferably in contact with the outer circumferential surface (flexible layer 38 in the present invention) of the drum 14. However, the reverse surface of film F may also be in contact with the outer circumferential surface of the drum 14. In addition, it is desired that the thermally developable emulsion layer of the film F is also in contact with the outer circumferential surface of the drum 14. However, it may be designed that the back surface of film F is also in contact with the drum 14.

Following thermal development of visible images, the film F is detached from the surface of the drum 14 in the development section 130 and is guided toward cooling device 150A. By so doing, the film F is less likely to suffer flaws (scratches) and abrasion. Further, first, the developed film F is gradually cooled and then rapidly cooled in the cooling device.

Figure 7:
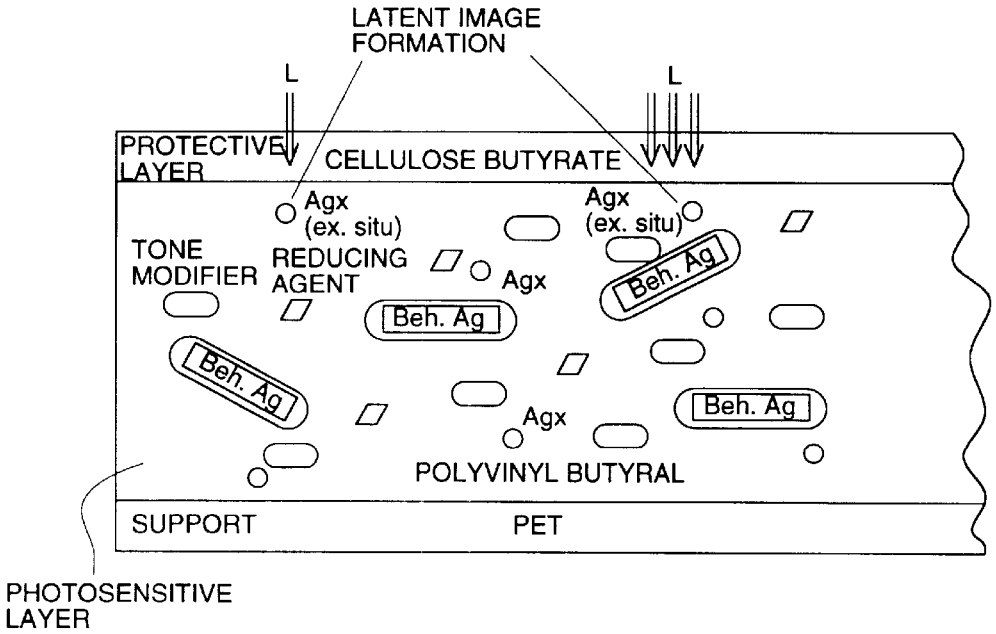
FIG. 7 is a cross-sectional view of film F and a schematic view illustrating chemical reactions in the film F during exposure.
Figure 8:
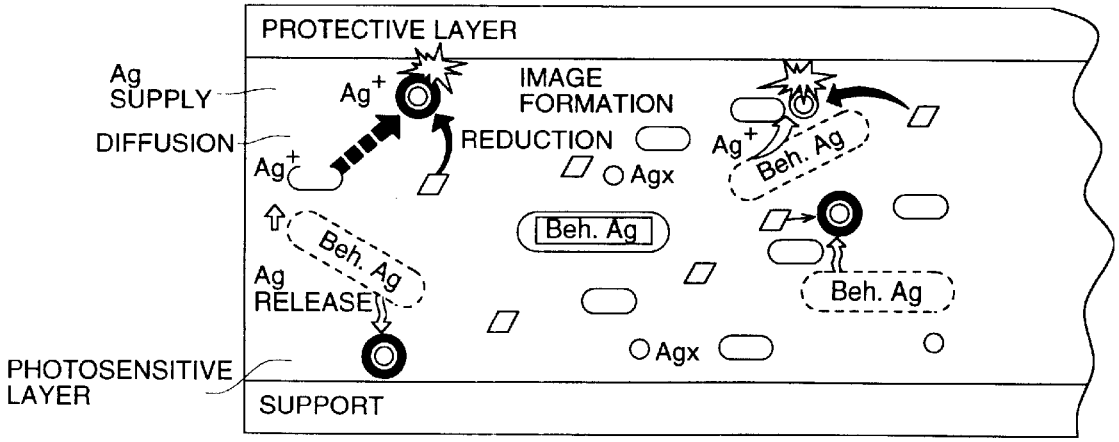
FIG. 8 is a cross-sectional view of film F and a schematic view illustrating chemical reactions in the film F during heating in the same manner as FIG. 7.

FIG. 7 is a cross-sectional view of the film F shown in the Example, which schematically illustrates chemical reactions in the film F during photographic exposure. FIG. 8 is a cross-sectional view similar to FIG. 7, which schematically illustrates chemical reactions in the film F during heating. The film F comprises a support (a substrate) comprised of PET having thereon a photosensitive layer comprised of polyvinyl butyral as the main component, and further thereon a protective layer comprised of cellulose butyrate. The photosensitive layer comprises silver behenate (Beh. Ag), reducing agents, and tone modifiers.

During exposure, when the film F is subjected to exposure employing laser beam L from the exposure section 120, as shown in FIG. 7, in the area exposed by the laser beam L, silver halide grains are sensitized to form a latent image. On the other hand, when heating the film F at the lowest thermal development temperature or higher, as shown in FIG. 8, a silver ion ($Ag^+$) is released from the silver behenate, and the silver behenate, which has released a silver ion, reacts with a colorant to form a complex. Thereafter, it is assumed that the silver ion diffuses away and a reducing agent undergoes a chemical reaction utilizing specks formed in exposed silver halide grains to form a silver image. In such a manner, the film F comprises photosensitive silver halide grains, organic silver salts, and silver ion reducing agents. It is designed so that thermal development does not substantially occur at no more than 40° C. but does occur at 80° C. or higher, i.e., the lowest thermal development temperature.

Incidentally, one problem with image formation based on such thermal development is that when the sheet of thermally developable material (film F) is not uniformly heated, temperature fluctuations occur in the thermally developable material to occasionally cause uneven image density. Accordingly, it is required that the entire outer circumferential surface of the drum 14 is heated to a uniform temperature, for example, nearly 120° C.

On the other hand, the sheets of thermally developable material (film F) are normally maintained at room temperature prior to being fed into the drum 14 so that the film F is not subjected to unintended thermal development. Therefore, the temperature of the sheet of thermally developable material is approximately 90 to 100° C. lower than the outer circumferential surface of the drum 14. As a result, when the sheet of thermally developable material is fed onto the drum 14, it cools the outer circumferential surface of the drum 14, and the temperature of the area in contact with the sheet is lowered.

In this embodiment, when the size of the sheet of thermally developable material fed onto the drum 14 is not varied and each sheet is held at the same position on the outer circumferential surface of the drum 14, the outer circumferential surface of the drum 14 is uniformly cooled except for the leading edge and most rear portions. Therefore, uneven density in the center image area does not particularly result. However, it is occasionally required that while minimizing the uneven image density near the leading edge and most rear portions, high quality image is surely obtained. Further, the size as described herein means the length of the sheet of thermally developable material in the rotational direction of the drum 14.

In addition, it is occasionally required that different-sized sheets of thermally developable material are randomly fed onto the drum 14. In such a case, when for example, a plurality of small-sized sheets of thermally developable material are fed, the outer circumferential surface of the drum 14 in contact with such sheets is cooled to form an area in which the temperature is partially lowered. Thereafter, when a larger sheet of thermally developable material is fed so that it covers an area in which the temperature was lowered and another area in which the temperature was not lowered, a major difference in image density is caused at the boundary area. Due to such density difference, image quality is occasionally degraded.

In order to overcome this problem, it may be considered that when the temperature of the outer circumferential surface of the drum 14 lowers, after peeling the heated sheet of thermally developable material from the drum 14, the feeding of the following sheet is postponed, until the temperature of the outer circumferential surface of the drum 14 becomes uniform. However, because it takes a relatively longer time, until the temperature of the outer circumferential surface of the drum 14 becomes uniform, a new problem occurs in which owing to that, the processing time is extended.

Figure 9:
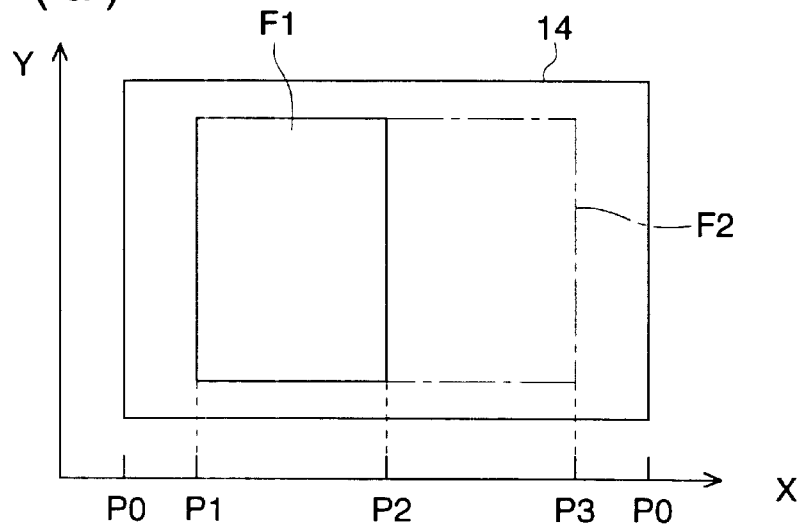
FIGS. 9(*a*) to 9(*d*) are diagrams for depicting problems of conventional techniques.
Figure 9:
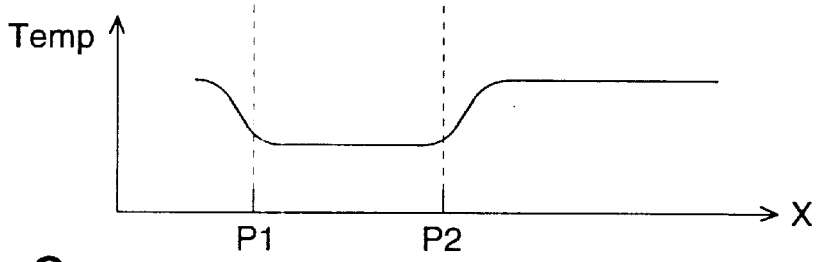
Figure 9:
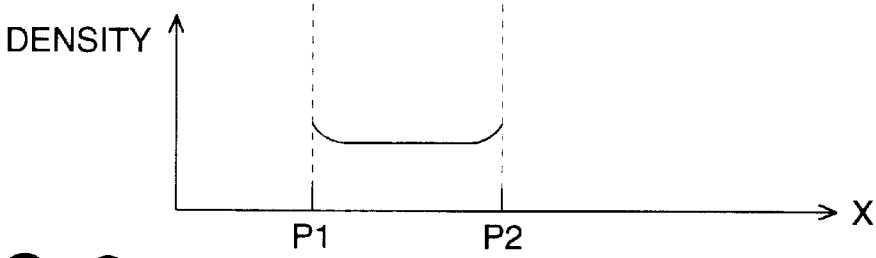
Figure 9:
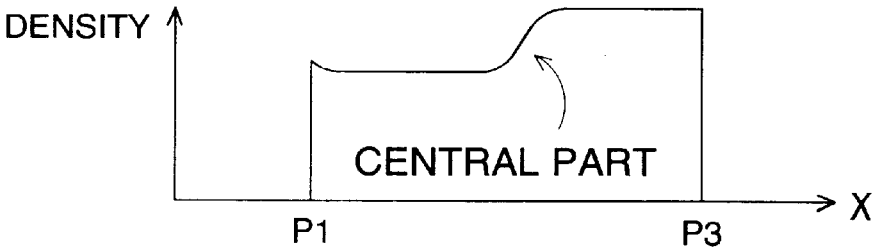

FIGS. 9(*a*) through 9(*d*) are diagrams which illustrate such a problem. FIG. 9(*a*) is a development showing the drum 14, and sheets of film F1 and F2 which are placed, in which the ordinate shows the position on the drum 14 across the width and the abscissa shows the position on the drum 14 in the rotational direction. FIG. 9(*b*) is a diagram showing the temperature distribution on the outer circumferential surface of the drum 14 in which the ordinate shows the temperature and the abscissa shows the position on the drum 14 in the rotational direction. FIGS. 9(*c*) and 9(*d*) are diagrams showing the density distribution of images on film F, in which the ordinate shows density and the abscissa shows the position on the drum 14 in the rotational direction. Further, as FIG. 9 shows, it is assumed that the sizes of film F1 and film F2 are shorter than the circumference of the drum 14.

Herein, it is assumed that at least two small-sized sheets of film F1 are heated in the same area P1 to P2 on the drum 14. In such a case, the area P1 to P2 on the outer circumferential surface of the drum 14 is cooled, and as shown in FIG. 9(*b*), the temperature of the area P1 to P2 is likely approximately 3° C. lower than the other area, though the temperature decrease depends on temperature conditions of the film F, and the like. In such a state, when the same small-sized sheets of film F are heated in the same area P1 to P2, the resultant temperature distribution depends on the temperature distribution of the outer circumferential surface of the drum 14, which is shown in FIG. 9(*b*).

During the thermal development of the present embodiment, as the heating temperature is raised, image density tends to increase. Accordingly, as shown in FIG. 9(*c*), the image density on the film Fl is higher at position P1 and P2, that is, the leading edge portion and the rear-most portion, than that of the other area. When a main image is not formed in the area near the leading edge portion and the rear-most portion, problems with image density is less likely to occur. However, even in the area near the leading edge portion and the rear-most portion, it is occasionally desired to minimize fluctuations of image density.

Further, at least two small-sized sheets of film F1 are successively heated in the same area P1 to P2 on the drum 14, and thereafter, when a large-sized sheet of film F2 is heated in the area P1 to P3 on the drum 14, the resulting temperature distribution of the large-sized sheet is that as shown in FIG. 9(*b*), a portion (near position P2), in which relatively large variation occurs, is formed in the central area of the film F2.

As described above, when the film F2 is heated, while leaving the portion in which the temperature distribution is not uniform, the image density in the central area on the film F2 differs from the remaining area. As a result, it is difficult to obtain overall high quality images. Specifically, because the central area on the film F2 being the major focus point, the viewers would tend to be dissatisfied.

Accordingly, the present embodiment is designed so that the fluctuations of image density are minimized employing the constitution described below.

Namely, when sheets of film F, which are successively heated on the outer circumferential surface of the drum 14, are always identically positioned, the temperature of the position decreases. Therefore, if sheets are successively fed to different positions, the outer circumferential surface of the drum 14 will be uniformly cooled. Thus, it is possible to maintain temperatures for a nearly uniform distribution.

Further, of course, each of sheets of thermally developable material which is successively heated by the drum 14 means each of sheets of the thermally developable material which is fed to the drum 14 at the time interval of the shortest time interval Tmin.

More specifically, formula 12 described below is satisfied in terms of arbitrary natural number N;

formula 12=

$$Tmin \neq N \times TR$$

wherein Tmin denotes the shortest time interval between the time when the leading edge of each sheet of film F is fed to the drum 14, and TR denotes the time required for one rotation of the drum 14.

Namely, it suggests that the sheet of film F is successively fed to the drum 14 employing a pair of supply rollers 143 at such timed feeding that the position, at which the leading edge of each sheet of film F is held against the drum 14, is shifted in the rotational direction of the drum 14.

Further, in the present embodiment, formula 1 described below is satisfied in terms of arbitrary natural number N;

formula 1=

$$(N-1/20)\times TR \geqq Tmin$$

or $$(N+1/20)\times TR \leqq Tmin$$

wherein TR denotes the time required for one rotation of the drum 14, and Tmin denotes the shortest time interval between the time when the leading edge of sheets of thermally developable material is fed to the drum 14. By so doing, the position on the drum 14 to which each sheet of film F is successively fed is shifted by at least 360 degrees/20=18 degrees being the resultant angle between them. As a result, it is possible to efficiently keep the temperature distribution of the outer circumferential surface of the drum 14 uniform, and thereby, uneven temperature distribution is not likely to occur and formation of uneven image density is effectively minimized.

Further, formula 2 described below is satisfied in terms of arbitrary natural number N;

formula 2:

$$(N-1/20)\times TR \geqq 2\times Tmin$$

or $$(N+1/20)\times TR \leqq 2\times Tmin$$

wherein Tmin denotes the shortest time interval between the time when the leading edge of the sheet of thermally developable material is fed to the drum and the time when the following sheet is fed to the drum, TR denotes the time required for one rotation of the drum.

Since the position of each of thermally developable materials fed on the drum is different by 1/20 of the circumference of the drum from others among the thermally developable materials continuously heated by the drum on the basis of every other sheet, uneven temperature on the drum in the rotational direction is less likely to result, and owing to that, it is possible to effectively minimize the formation of uneven density.

Further, especially, it may more preferable that the shortest time interval Tmin between the time when the leading edge of the sheet of thermally developable material is fed to the drum and the time when the following sheet is fed to the drum and the time TR required for one rotation of the drum satisfy formula 13 to 15.

formula 13=

$$21/40\times TR \cdot Tmin \cdot 19/20\times TR$$

formula 14:

$$21/20\times TR \cdot Tmin \cdot 59/40\times TR$$

formula 15:

$$61/40\times TR \cdot Tmin \cdot 39/20\times TR$$

With this structure, since 21/40×TR·Tmin, the shortest time interval Tmin is a sufficient time period so that the temperature on the outer circumferential surface of the drum 14 can be restored during the shortest time interval Tmin before the next film is continuously thermally developed after a single sheet of film F is thermally developed. Further, since Tmin·39/20×TR, the shortest time interval Tmin is short enough to make a high productivity to thermally develop the thermally developable materials.

Further, it may be preferable that an existing ratio of natural number N which satisfy all formulas 3 to 5 described below is 50 percent or more in terms of an arbitrary natural number.

formula 3:

$$(N-1/20)\times TR \geqq T(n)$$

or $$(N+1/20)\times TR \leqq T(n),$$

formula 4:

$$(N-1/20)\times TR \geqq T(n+1)$$

or $$(N+1/20)\times TR \leqq T(n+1),$$

formula 5:

$$(N-1/20)\times TR \geqq T(n)+T(n+1)$$

or $$(N+1/20)\times TR \leqq T(n)+T(n+1)$$

wherein TR denotes the time required for one rotation of the drum, T(n) denotes the interval between the time when the leading edge of a sheet of thermally developable material is fed at n-th order to the drum and the time when the leading edge of the following sheet of thermally developable material is fed at (n+1)-th order to the drum.

With this structure, among the thermally developable materials continuously heated by the drum, that is, not only among the thermally developable materials fed to the drum with the shortest time interval Tmin, but also among the thermally developable materials fed to the drum with the more long time interval, the probability of the leading edge of the sheet of thermally developable material being substantially fed onto the same position of the drum becomes low. As a result, areas of uneven temperature on the drum in the rotational direction are not likely to result, and owing to that, it is possible to effectively minimize the formation of uneven temperature. The temperature distribution on the outer circumferential surface of the drum can be made effectively to be even and occurrence of density uneveness on an image can be effectively refrained.

Such relationships will be described. In the case of n=1, time interval T1 between feeding of the film F1 and the following film F2 is adjusted so as to satisfy formula 3; time interval T2 between feeds of the film F2 and the following film F3 is adjusted so as to satisfy formula 4; and time interval T1+T2 is adjusted so as to satisfy formula 5. However, in the case of n=2, when time interval T3 between feeds of the film F3 and the following film F4 does not satisfy formula 4. For example, when 100 sheets of film F are continuously thermally developed, if a number of sheets satisfying all formula 3 to 5 is 50 sheets and a number of sheets not satisfying one of formula 3 to 5 is 50 sheets, the above-mentioned existing ratio becomes 50 percent. In such a manner, the existing ratio can be statistically obtained from the timed feeding.

Further, the existing ratio of the natural number n which satisfies the above formulas may be obtained in such a manner that each time when the number of M sheets (M sheets may be preferable to be 100 sheets or more) of film F are continuously thermally developed, the leading edge portions of these sheets of film F are fed onto the drum is recorded, and the percentage of the natural number n, which satisfies the above formulas is obtained employing time TR for one rotation of the drum, however the obtaining method is not limited to this. Furthermore, from the viewpoint of effective minimization of uneven density, the existing ratio of natural numbers, which satisfy the above formulas, is preferably at least 70 percent (and more preferably, at least 90 percent).

Figure 10:
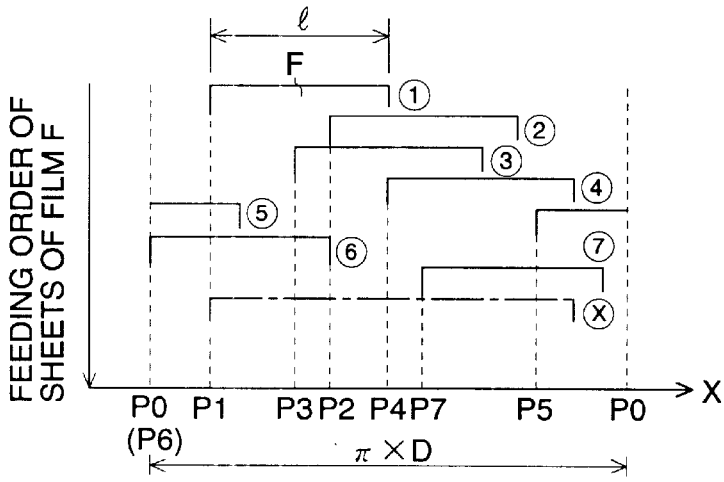
FIGS. 10(*a*) to 10(*d*) are diagrams for depicting the embodiments in which fluctuation in image density decreases according to the present embodiment.
Figure 10:
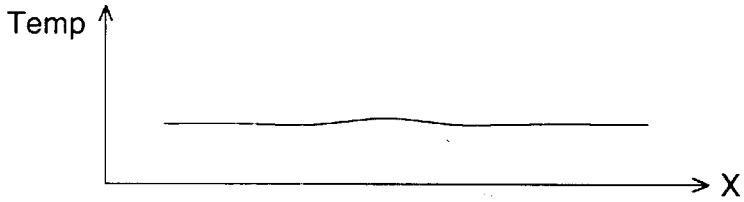
Figure 10:
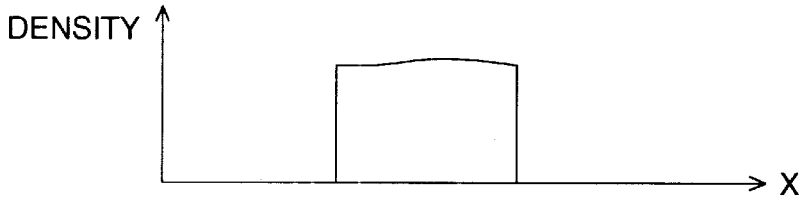
Figure 10:
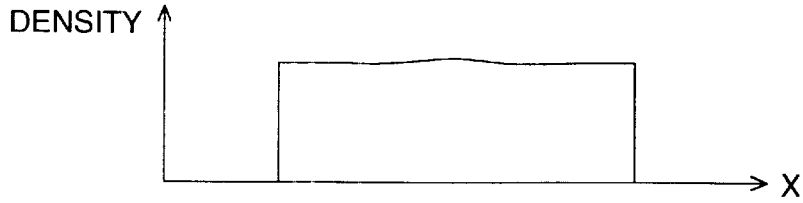

Now, a method to reduce density irregularities will be explained with reference to the drawings. FIG. 10 is a diagram describing a constitution to minimize the fluctuation of image density. FIG. 10(*a*) is a development showing the positions of successively fed plurality of sheets of film F on the drum 14, in which the ordinate shows the fed order of sheets of film F, and the abscissa shows the position of the drum 14 in the rotational direction. FIG. 10(*b*) is a diagram showing the temperature distribution on the outer circumferential surface of the drum 14, in which the ordinate shows the temperature and the abscissa shows the position of the drum 14 in the rotational direction. FIGS. 10(*c*) and 10(*d*) are diagrams showing the density distribution on the film F, in which the ordinate shows the density and the abscissa shows the position of the drum 14 in the rotational direction.

Further, a method to reduce density irregularities will be explained more concretely with reference to the drawings. More specifically, as shown in FIG. 10(*a*), when the sheet of film F which is first heated is held in an area starting from position P1 and the subsequent sheet of film F which is heated is held in the area aligned with position P2, which is shifted from position P1, the outer circumferential surface of the drum 14 is uniformly cooled. Accordingly, the temperature distribution of the outer circumferential surface becomes almost uniform as shown in FIG. 10(*b*). Therefore, irrespective of small-sized sheets of film F1 or large-sized sheets of film F2, it is possible to heat the entire surface of each sheet uniformly. By so doing, it is possible to make the image density distribution nearly uniform (refer to FIGS. 10(*c*) and 10(*d*)).

Further, in the present embodiment, as described above, since the temperature distribution of the outer circumferential surface can be kept nearly constant, it is possible to heat, in random order, sheets of film of the same length as well as different length in the rotational direction of the drum 14. More specifically, after heating a plurality of small-sized sheets of film, it is possible to minimize the formation of uneven temperature across the positions, in the rotational direction on the drum 14, at which the rear portion of the sheet of film is positioned. Therefore, after heating these sheets of film, even though a larger-sized sheet of film is heated, for example, as shown by an alternate long and short dash line x in FIG. 10(*a*), it is possible to achieve uniform image density at all portions to improve overall image quality.

Next, described will be a mechanism to determine timing, which feeds the film F to the drum 14 in accordance with the present embodiment. In FIG. 4, motor 151 is connected to one of paired feeding rollers 143. Furthermore, the motor 151 feeds at random timing the film F conveyed from the exposure section 120 to the drum 14 without performing any operation. This is due to the fact that when image data employed during exposure at the exposure section is subjected to conversion from a compressed data form for transmission to a data form for exposure, the time necessary for the conversion is different for each image data, and thus the timing which was capable of reproducing the image data becomes random timing. Accordingly film F is conveyed from the exposure section 120 at random timing.

Further, in this case, the following is recommended. In conveying direction altering section 145 provided in the common film conveying path for a plurality of different-sized sheets of film F which varies the film conveying direction (3) to (4), during the shortest time interval Tmin from the time when a sheet of the film F enters the conveying direction altering means 145 to the time when the film F leaves the same, naturally, the next sheet of film F is not allowed to enter the conveying direction altering means 145 so that the next sheet of film F is not piled onto the previous one. In order to realize the above-mentioned sequence, it is required that any of the above cited formulas 13, 14, and 15 are satisfied. In addition, when a time required to convert the transmitted compressed data form to the exposure data form exceeds the shortest time interval Tmin, a sheet of film F is fed to the exposure section 120 at random timing so that the sheet of film F waits until the image data are converted to the original form.

By so doing, without providing a special control device, it is possible to enhance the likelihood in which arbitrary natural number N satisfies all of the above cited formulas 3, 4, and 5. Furthermore, it is preferred that the following is easily achieved, in which in the conveying direction altering section 145, the conveying direction of film may be varied, the conveyance path may be designed without any particular limitation, dimensions of apparatus may be reduced, and jammed film is readily removed.

Further, when the exposure section 120 is constituted in such a manner that exposure is carried out while film F is stationary, needless to say, the exposure section 120 may also work as the conveying direction altering section 145.

MODIFIED EXAMPLE 1

Next, the modified example of the present embodiment will be described. A time interval, which exceeds the shortest time interval Tmin is so controlled as to become random. However, timed feeding may be regulated so that the above cited formulas 3, 4, and 5 are satisfied for arbitrary natural number N while being suitably driven through control from the control device 15.

Specifically, the functions in the modified example are those in which the paired rollers 143 are temporarily stopped when film F reaches the paired rollers 143, and timing to feed the film F onto the drum of the development section 130, which rotates at a constant speed, is determined. In this case, the feeding means comprises the paired rollers 143, the motor 151, and the control device 150. In this case, the film F conveyed from the lower conveying section 142 (refer to FIG. 1) stops before reaching the paired feeding rollers 142, while the rotation of the paired rollers is stopping. Herein, the control device 150 is loaded with a program which feeds the film F onto the drum 14 at constant time interval T, which satisfies the formulas 21 and 22 described below for arbitrary natural number N through detecting the phase of the drum 14, employing a sensor (not shown). Thus, based on the program, drive signals are transmitted to the motor 151 at suitable timing, and the motor 151 rotates until the sensor 151 detects the passage of the rear end of the film F. Based on such rotation of the motor 151, the paired rollers 143 are put into operation, enabling feeding of the film F onto the drum 14. Further, depending on timing for conveying the film F, the paired feeding rollers 143 rotate occasionally. In such cases, when the drum 14 rotates to a specified position, the paired feeding rollers 143 start rotating. Thus the film F is fed onto the outer circumferential surface of the drum 14 at constant time interval T so as to satisfy the formulas 21 and 22 described below.

Formula 21:

$$(N-1/20)\times TR \geqq T$$

or $$(N+1/20)\times TR \leqq T$$

Formula 22:

$$(N-1/20)\times TR \geqq 2\times T$$

or $$(N+1/20)\times TR \leqq 2\times T$$

wherein TR denotes the time required for one rotation of the drum 14, T denotes the constant time interval until the leading edge of the film F is fed onto the drum 14, and N denote an arbitrary natural number.

Further, in the present modified example, by satisfying the above cited formulas, between sheets of film F, which are successively heated, the fed position on the drum 14 is shifted by at least 1/20 of the drum circumference. Namely, by setting the shift amount between successively fed sheets of film at no less than 360/20=18 degrees, the temperature distribution on the outer circumferential surface of the drum 14 may be efficiently made to be uniform, and due to that, uneven temperature on the drum 14 in the rotational direction is unlikely to occur, and the generation of uneven density on images is effectively minimized.

Furthermore, by satisfying the above cited formula 22 for arbitrary natural number N, in which TR denotes the time required for one rotation of the drum 14, and Tmin denotes the shortest time interval until the leading edge of the film F is fed onto the drum 14, the position on the drum 14, at which every other sheet of the film F is fed, is shifted by at least 1/20 of the circumference of the drum. Therefore, uneven temperature on the drum 14 in the rotational direction is further unlikely to result, and due to that, the generation of uneven density is further effectively minimized.

MODIFIED EXAMPLE 2

Furthermore, the additionally modified example of the initially modified example is constituted is as follows. The feeding means comprises sensor 152 which detects the leading edge of the film, paired feeding rollers 143 provided at the upstream position in the conveying direction of the sensor 152, motor 151, and control device 150 comprising a clock. When the sensor 152 detects the leading edge of the film F, based on the time when the sensor 152 detected the passage of the leading edges of the previous film F and the sheet of film F earlier than that, as well as its clock, the control device 150 transmits drive signals to the motor 151 at constant time interval T, which satisfies all of the above cited formulas 21 and 22 for arbitrary natural number N, and rotation continues until the sensor 152 detects the passage of the rear edge of the film F. In cases other than that, the rotation of the paired feeding rollers 146 stops, and the film F conveyed from the lower conveying section 142 (refer to FIG. 1) temporarily stops until the constant time interval is reached. By such rotation of the motor 151, the paired feeding rollers 151 start operation, and the film F may be fed onto the drum 14. Further, depending on timing of conveying of the film F, the paired feeding rollers 143 are occasionally rotating.

As described above, the control device 150 regulates feed timing of the film F with respect to the drum 14. For example, as shown in FIG. 10(*a*), a position holding the film F is suitably shifted. As a result, it is possible to markedly minimize the fluctuation of image density obtained by photographic processing.

Further, the film F is held at an optional position employing the outer circumferential surface of the drum 14 and the roller 16. Therefore, it is unnecessary to provide a film holding mechanism on the drum 14, however, an appropriate chucking mechanism may be provided, if desired.

Furthermore, when the shortest time interval Tmin is no more than 27 seconds, it is possible to shorten the processing time for successive film F developing. However, if the roller with which a thermally developable material fed onto the drum is first brought into contact is a hollow roller, the temperature of the roller is rapidly lowered, and a difference in temperature between the leading edge of the thermally developable material and the rear edge thereof is generated, uneven density resulting. However, when the roller with which the thermally developable material fed onto a drum is first brought into contact is a hollow roller, such difference in temperature is minimized. In addition, the resulting effect is synergistically enhanced by an uneven temperature minimizing effect obtained by bringing the rotational cycle of the drum into synchronization with the film feeding interval, and uneven density is effectively minimized.

Furthermore, when the shortest time interval Tmin is no more than 27 seconds, the temperature of the elastic layer surface is likely to markedly decrease through thermally developing only one sheet of thermally developable material. However, since time TR for one rotation of the drum is relatively long compared to the shortest time interval Tmin until the leading edge of the thermally developable material is fed onto the drum, by allowing the shortest time interval Tmin to satisfy the above-mentioned TR as well as the formulas 8 or 9 described below, any decrease of the temperature on the elastic layer surface due to the thermal development of only one sheet is likely to be recovered before the next thermally developable material is fed. In addition, by bringing the rotational cycle of the drum into synchronization with the film feeding interval, any uneven temperature is minimized. As a result, uneven density is synergistically minimized.

Formula 8:

$$19/20 \times TR \geqq Tmin \geqq 21/40 \times TR$$

Formula 9:

$$26/20 \times TR \geqq Tmin \geqq 21/20 \times TR$$

In this case, by allowing time TR for one rotation of the drum 14 to satisfy the formula 10 described below, the drum 14 is allowed to have sufficient time for one rotation. As a result, it is possible to make the winding angle on the drum 14 small while taking sufficient development time, and the film F may be handled without specific limitation. Thus when the film F is removed from the drum 14, it is unnecessary to bend the the film F at a large angle and thermally developed the film F is not likely to be subjected to curl. In addition, further desirable effects are likely to be obtained, such as that the outer circumferential surface of the drum 14 is uniformly cooled by the film F, and it is possible to minimize uneven density. Further, needless to say, the shortest time interval Tmin includes the constant time interval T of the modified example of the present embodiment.

Formula 10:

$$19/20 \times TR \geqq Tmin \geqq 21/40 \times TR$$

Furthermore, in the present embodiment, the formula described below is satisfied:

Formula 6:

$$\pi \times D < 2 \times Lmax$$

wherein π denotes the ratio of the circumference of a circle to its diameter, D denotes the diameter of the outer circumferential surface of the drum 14, and Lmax denotes the length of film in the rotational direction, in which the size in the rotational direction of the drum 14 is maximum.

When constituted as described above, the dimensions of the drum 14 may be decreased, and due to that, it may be possible to make the constitution of thermal development apparatus 100 more compact. However, when an apparatus is simply constituted as described above, distinct uneven density results at the central part of a thermally developable material. However, as described above, by shifting the position on the outer circumferential surface of the drum 14 at which the leading edge of the film F is held, uneven density formed in the central part of the thermally developable material is effectively minimized.

Furthermore, on the other hand, by satisfying the formula 7 described below, the drum diameter is increased while matching with the length in the rotational direction of a thermally developable material of which length in the rotational direction is minimum. As a result, it is possible to enhance the photographic processing capability, to minimize curl, and to increase the heat capacity of the drum to more than the predetermined one. Accordingly, it is possible to minimize a decrease in temperature of the entire drum as well as the formation of uneven density.

Formula 7:

$$Lmin < \pi \times D$$

wherein Lmin denotes the length of the film F in the rotational direction of which length in the rotational direction of the drum 14 is minimum, D denotes the diameter of the outer circumferential surface of the drum 14 holding the film F, and π denotes the ratio of the circumference of a circle to its diameter.

Further, if the width of the heating area on the outer circumference of the drum 14 is formed to be wider than the film F, it becomes possible to form a visible image over the entire area of the film F.

Furthermore, because smoothness is essentially required for the outer circumferential surface of the drum 14, it is not allowed to provide a temperature sensor which detects the temperature of drum 14 on the outer circumferential surface of the drum 14. Accordingly, such a temperature sensor is naturally provided in the interior of the drum 14. In the drum 14 of the present embodiment, the temperature sensor is provided in close contact with the internal circumference of a metal holding member while flat heater 32 is also provided in close contact with the internal circumference of the metal holding member. Thus heating of the heater 32 is controlled in response to the temperature detected by the temperature sensor.

However, the difference between the temperature on the elastic layer surface and the temperature detected by the temperature sensor due to the difference in those positions becomes large at timing (timing of mainly feeding the film F onto the surface of the drum 14) of heating the film F and becomes small at timing other than that. As a result, the leading area and the rear area of the film F are thermally developed at substantially different temperatures, and a problem with the formation of uneven density occurs.

Therefore, for example, information regarding timing of feeding the film F onto the surface of the drum 14 is obtained from sensor 152 shown in FIG. 4, and in response to such information, heating of the drum 14 is controlled employing the flat heater 32 provided in close contact with the internal circumference of the drum 14, and the like. Thus by setting a control target temperature of the heater 32 at timing of feeding the film F onto the surface of the drum 14 higher than timing other than that, the heat amount generated by the heater 32 is increased so that a temperature difference on the elastic layer surface does not occur. As a result, uneven temperature due to the adverse effect is minimized. In addition, uneven density is synergistically minimized in combination of the effect minimizing uneven temperature by bringing the rotational cycle of the drum 14 into synchronization with the film F feeding interval.

Figure 11:
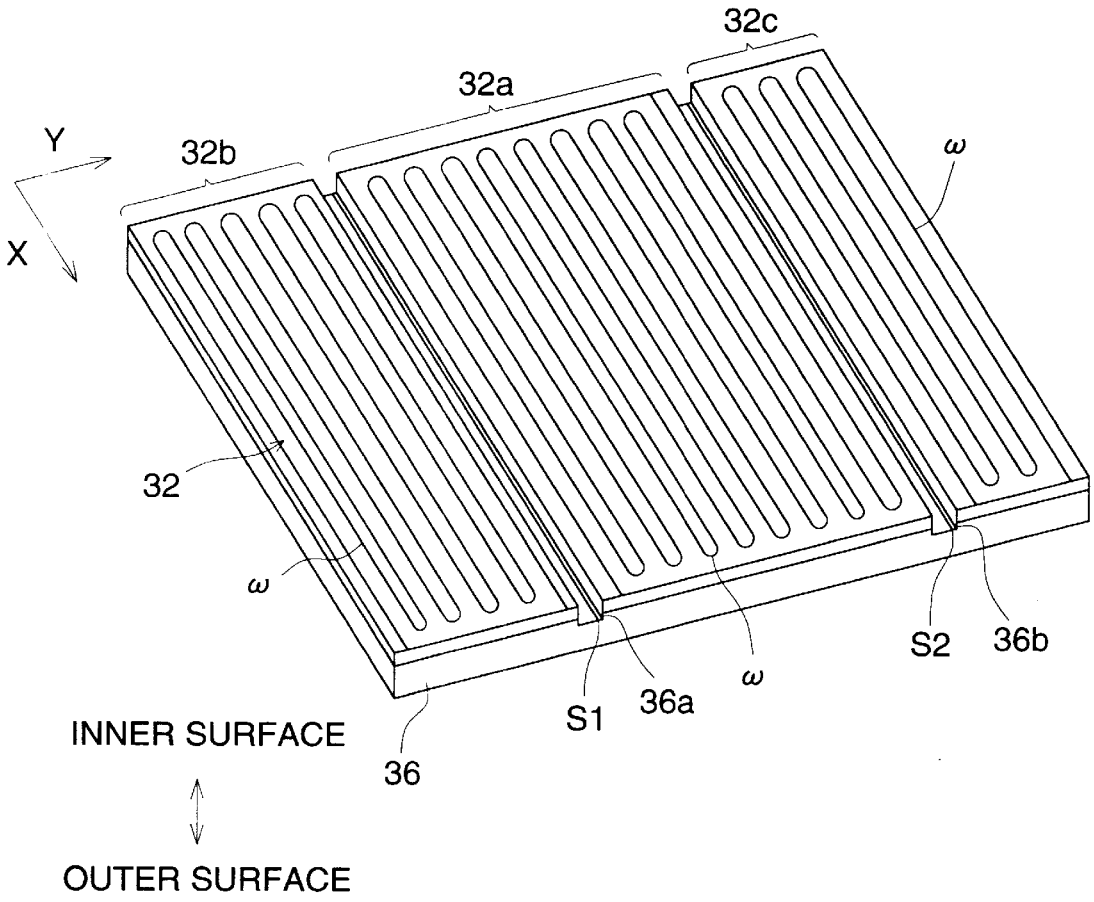
FIG. 11 is a perspective view showing a supporting tube 36 according to another embodiment of the present invention.

FIG. 11 is a developed view of holding tube 36 according to the present embodiment. The Y direction corresponds to the width direction of the film F while the X direction corresponds to the length direction of the film F. The outer circumferential surface of the drum 14 becomes the bottom side. The flat heater 32 is constituted, for example, by allowing a nichrome wire "w" to be laid in serpentine fashion and the like at narrow intervals on the surface (internal circumferential surface) of holding tube 36, which is divided into central section 32*a* and side part sections 32*b* and 32*c* adjacent to the Y direction. In each of sections 32*a,* 32*b,* and 32*c,* the heater 32 is capable of being independently controlled.

Groove 36*a* is formed between side part section 32*b* and central section 32*a* on the internal surface of the holding tube 36, while groove 36*b* is formed between the central section 32 and the side part section 32*c* on the internal surface of the holding tube 36. In the groove 36*a,* wire-shaped temperature sensor S1 is provided, while in the groove 36*b,* wire-shaped temperature sensor S2 is provided. Sensors S1 and S2 cannot measure the temperature of the heater 32, but can measure the temperature of the holding tube 36 by utilizing the electric resistance, which varies. Further the heater 32 as well as sensors S1 and S2 are covered with a heat insulating layer (not shown).

Herein, when film F, with a width nearly similar to that of the central region 32*a* is fed onto the drum 14, the central region 32*a* is cooled by the film F. Thus the heater 32, located in the central region 32*a,* is subjected to heating control and in conjunction with that, the temperatures of side regions 32*b* and 32*c* increase accordingly.

Furthermore, in the region on which the film F passes, the temperature sensor will detect a temperature higher than the surface temperature of the drum 14, while in the region on which the film F does not pass, the temperature sensor will detect a temperature nearly similar to the surface temperature of the drum 14. Specifically, when the shortest time interval until the film F is fed to the drum 14 is short, such as no more than 27 seconds, the time interval until the following the film F is fed after thermally developing the previous film F becomes very short to increase the difference between the real surface temperature of the drum 14 and the temperature detected by the temperature sensor. Therefore, the resulting problem is overcome by satisfying the formula 11 described below:

Formula 11:

$$Te11-Te12<Te21-Te22$$

wherein Te11 denotes the target control temperature of the heater at timing of feeding to the drum surface the film F on the heater corresponding to the region over which the film does not pass, Te12 denotes the target control temperature of the heater at timing other than that, Te21 denotes the target control temperature of the heater at timing of feeding onto the drum surface the thermally developable material on the heater corresponding to the region over which the film F passes, and Te22 denotes the target control temperature at timing other than that.

Namely, at timing of heating the film F in the region over which the film F passes, the temperature difference, due to location difference between the elastic layer surface and the temperature sensor, is greater than that at timing other than that. On the other hand, in the region over which the film F does not pass, unevenness in the conveying width direction results, though its variation is not great. However, by satisfying formula 11, uneven temperature due to these adverse effects is minimized. In addition, by synchronizing the rotation cycle with the film feeding interval, uneven temperature is further minimized, and uneven density is also synergistically minimized.

For example, in the region over which the film F passes, the target control temperature is raised at timing of feeding the film F onto the drum 14 while the target control temperature of the heater 32 is lowered at timing other than that of feeding the film F to the drum 14. By so doing, it is possible to minimize uneven temperature due to the surface position of the drum 14 as well as the time of the drum 14 is minimized. As a result, uneven density is desirably minimized.

Further, in the present embodiment, the temperature sensor is provided in close contact with the holding tube 36, and measures the temperature of the holding tube 36 to control the temperature. However, the temperature sensor may be provided in close contact with the heater 32 so that temperature control is carried out by directly measurement of the temperature of the heater 32.

Further, in the temperature control in which values set from the time when the leading edge of the film F is first brought into contact with the drum 14 to the time when the rear edge of the film F is first brought into contact with the drum 14, and values set during any other period of time are regarded as targets, when smoothed employing a ramp process, smoother temperature control is preferably achieved.

Further, in the apparatus of the present embodiment, development time is approximately 15 seconds, the drum diameter is approximately 0.161 mm, and the angle (being the angle of the drum 14 employed for thermal development) is approximately 220 degrees. Based on these, it is clear that the time required for one rotation of the drum 14 is 24.5 seconds and the circumferential speed is 0.0206 m/second.

Furthermore, for maximum film size of 0.356×0.432 m, e.g., half-cut size, in the conveying direction altering section 145, during the shortest time interval Tmin from the entrance of the film F to leaving of the film F in the conveying direction (4), the following film is not allowed to enter the conveying direction altering section 145 so that sheets of the film F do not overlap in the conveying direction altering section 145. As a result, Tmin is 38.3 seconds.

The content of photosensitive silver halides incorporated into thermally developable materials may typically be in the range of 0.75 to 25 mole percent of organic silver salts, and is preferably in the range of 2 to 20 mole percent.

The silver halides may include silver bromide, silver iodide, silver chloride, silver bromoiodide, silver chlorobromoiodide, silver chlorobromide, and the like. Silver halides are not limited to these and shapes include all photosensitive shapes such as cube, orthorhombic system, planar, tetrahedron, and the like.

Organic silver salts include every organic material comprising a silver ion reducing source. Silver salts of organic acids, particularly long chain fatty acids (having carbon atoms of 10 to 30, and preferably of 15 to 28) are preferred. Organic or inorganic silver complexes are preferred which exhibit definite stability having ligands of 4.0 to 10.0 in total, and the content is between about 5 and about 30 percent of the weight of the image forming layer.

The organic silver salts, which may be employed in the present thermally developable materials, are silver salts which are relatively stable against light and form silver images when heated at 115 to 120° C. or higher, in the presence of exposed light catalysts (for example, photographic silver halides and the like) together with reducing agents.

Preferred organic silver salts include those of organic compounds having a carboxylic group. Among those, included are silver salts of aliphatic carboxylic acids as well as silver salts of aromatic carboxylic acids. Preferred examples of silver salts of aliphatic carboxylic acids include silver behenate, silver stearate, and the like. Silver salts of a halogen atom or a hydroxyl group in aliphatic carboxylic acids may be advantageously employed. Silver salts of compounds having a mercapto group or a thione group and derivatives thereof may be employed. Further silver salts of compounds having an imino group may be employed.

Reducing agents for organic silver salts include all materials, which can reduce silver ions to metallic silver, and are preferably organic materials. Conventional photographic developers such as phenidone, hydroquinone, and catechol are preferably employed. However, phenol reducing agents are preferred. The content of the reducing agents should be between 1 and 10 weight percent of the image forming layer. When the reducing agents are incorporated into layers other than emulsion layers, the content is preferably between about 2 and about 15 weight percent, which is slightly higher than that in the emulsion layers.

In the thermal development to develop by the developing temperature not lower than 80° C., density irregularities tends to take place due to a small temperature difference caused by the thermal development in which thermally developable materials are fed to the same position on the outer circumferential surface of the drum. However, since a time period TR during which the drum rotates once and the shortest time interval Tmin to feed the leading end of a thermally developable material onto the drum satisfy formula 1 interms of arbitrary natural numeral N, thermally developable materials are not fed to the same position on the outer circumferential surface of the drum. As a result, the occurence of the density irregularities can be refrained and an image quality can be made excellent.

Incidentally, in the case that the thermally developable material containing silver halide light sensitive particles, organic silver salt, and silver ion deoxidizing agents is thermally developed with a temperature not lower than the lowest developing temperature not lower than 80° C., strong density irregularities take place even though temperature difference is very small. However, since a time period TR during which the drum rotates once and the shortest time interval Tmin to feed the leading end of a thermally developable material onto the drum satisfy formula 1 interms of arbitrary natural numeral N, thermally developable materials are not fed to the same position on the outer circumferential surface of the drum. As a result, the occurence of the density irregularities can be refrained and an image quality can be made excellent. Further, since the light sensitivity of the thermally developable material is vey high, an exposing speed can be increased. As a result, an image formation can be made with a high productivity.

APPARATUS IMPROVING EXAMPLE

An example in which the thermally developing apparatus in the abovementioned embodiment is more improved. Among the plurality of rollers 16 which are rotatable and held onto the drum, at least the leading 4 rollers firstly coming in contact with the film F fed to the drum 14 are a solid roller made of iron. With this structure, if the shortest time interval Tmin is not longer than 27 seconds and a fist roller firstly coming in contact with the thermally developable material among the plurality of rollers is a hollow roller, the temperature of the roller is abruptly dropped. Accordingly, the temperature difference between the leading edge and the trailing edge of the thermally developable material takes place and density irregularities occur. However, if a fist roller firstly coming in contact with the thermally developable material among the plurality of rollers is a solid roller, since this roller 16 has a large thermal capacity, this roller 16 can heat the reverse surface of the film F, a temperature difference taking place between the region on which the film F located and the other region can be made smaller, and the developing time period can be made shorter. In other words, if the film F takes away the heat from the contact portion of the drum, the temperature drop may hardly occur, density unevenness that the density at the leading end of the film is different from that at the trailing end of the film may be refrained. Further, "the temperature unevenness caused by the synchronization between the rotation cycle of the drum and the feeding interval of the thermally developable materials" can be refrained. Furthermore, with the synergism by these effects, density irregularities can be refrained more preferably and the thermal development capable of obtaining an excellent image can be conducted.

Also, in the case that the shortest time interval Tmin is not longer than 27 seconds, the temperature on the surface of the elastic layer is greatly dropped only by developing a single sheet of the thermally developable material. However, if the thickness of the elastic layer is not thicker than 0.0007 (m), and a ratio of a thermal conductivity (W/m/K) to the thickness of the elastic layer is not larger than 500 ($W/m^2/K$), the heat is transmitted very well from the metallic supporting member to the surface of the elastic layer. Accordingly, the temperature drop on the surface of the elastic layer can be refrained and unevenness in temperature caused by the synchronization between the rotation cycle of the drum and the feeding interval of the thermally developable materials can be refrained. Further, with the synergism by these effects, density irregularities can be refrained more preferably. Further, from the view point to prevent temperature unevenness in the elastic layer, it may be preferable that a thermal conductivity of the elastic layer is not smaller than 0.4 (W/m/K).

EXAMPLES

Film F will now be described below.

Silver halide-silver behenate dry soap was prepared according to a method described in U.S. Pat. No. 3,839,049. The total silver amount in the above-mentioned silver halide was 9 mole percent, while the total silver amount in silver behenate was 91 mole percent. The above-mentioned silver halide was a 0.055 $\mu$m silver bromoiodide grain emulsion comprising 2 percent of iodides.

A thermally developable emulsion was prepared by uniformly mixing 455 g of the above-mentioned silver halide-silver behenate dry soap, 26 g of toluene, 1918 g of 2-butanone, and polyvinyl butyral (B-79 manufactured by Monsanto). A mixture of the resulting thermally developable emulsion (698 g) and 60 g of 2-butanone was cooled to 12.8° C., while stirring. Added to the resulting mixture was pyridiumhydrobromideperbromide (0.92 g), and stirred for 2 hours.

Added to the resulting mixture was a calcium bromide solution (prepared by mixing CaBr (1 g) with 10 milliliters of methanol) and stirred for 30 minutes. Further added to the resulting mixture was polyvinyl butyral (158 g, B-79 manufactured by Monsanto and stirred for 20 minutes. The temperature of the resulting mixture was raised to 21.1° C., and the following was added over 15 minutes while stirring;

2-(Tribromomethylsulfone)quinoline 3.42 g 1,1-Bis(2-hydroxy-3,5-dimethylphenyl)-3,5,5-trimethylhexabe 28.1 g Solution containing 0.545 g of 5-methylmercaptobenzimidazole 41.1 g 2-(4-Chlorobenzoylbenzoic acid 6.12 g S-1 (sensitizing dye) 0.104 g Methanol 34.3 g Isocyanate (Desumoda N3300, manufactured by Mobay) 2.14 g Tetrachlorophthalic anhydride 0.97 g Phthalazine 2.88 g The structure of Dye S-1 is shown below.

S-1

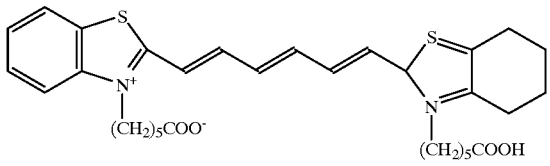

An active protective topcoat solution was prepared employing the components described below;

2-Butanone 80.0 g

Methanol 10.7 g

Cellulose acetate (CAB-171-155, manufactured by Eastman Chemicals) 8.0 g

4-Methylphthalic acid 0.52 g

MRA-1, Motoru reducing agent, tertiary polymer of ethylperfluorooctanesulfonyl-amidoethyl methacrylate/hydroxyethyl methacrylate/acrylic acid in a weight ratio of 70:20:10 0.80 g The resulting thermally developable emulsion and top coat composition were simultaneously coated onto a 0.18 mm blue-tinted polyester film substrate. A knife coater was constituted in such a manner that two bars and knives for simultaneous coating were provided 15.2 cm apart from each other. During coating the silver trip layer and top coat, multilayer coating was carried in such a manner that the silver emulsion was poured onto the film substrate prior to a rear knife and the top coat was poured onto the film substrate prior to a front bar.

The resulting film was pulled forward so that subsequently, both layers were simultaneously coated. This was achieved by carrying out one multilayer coating method. The coated polyester substrate was dried at 79.4° C. for 4 minutes. The knives were adjusted so that the silver layer yielded a dried layer weight of 23 g per $m^2$ and the top coat yielded a dried layer weight of 2.4 g per m.

Film F prepared by coating as described above was cut into many sheets having a size of 0.256×0.356 m (10×14 inches) as well as of 0.356×0.432 m and the resulting sheets were stacked. A light shielding film was prepared for placing 126 stacked sheets of cut film F of each size into case C. The 126 stacked sheets of film F were then packaged by each size with the prepared light shielding film.

Experiments

In order to perform experiments described below, light shielded 0.256×0.356 m size sheets of film F were placed in a first case C. Under light shielded condition, the package was opened and sheets of film F were placed into be a feedable state by removing the light shielding film. In the same manner, light shielded 0.356×0.432 m size sheets of film F were placed in a second case C. Under light shielded condition, the package was opened and the sheets of film F were placed into be a feedable state by removing the light shielding film.

Further, both sizes of film sheets were positioned in each case C so that when they were fed onto the drum 14, both sizes in the conveying width direction were 0.356 m, that is, each size in the conveying direction was different.

Experiment 1

Employing the above-mentioned thermal development apparatus (comprised of all rollers 16 composed of hollow rollers employing an aluminum tube having a wall thickness of 1 mm and a diameter of 2.18 cm; aluminum holding tube 36 of the drum 14, having a length of 45.7 cm, an outer diameter of 16 cm, and a wall thickness of 0.64 cm; flexible layer 38 having a surface roughness between 2.3 and 3.2 $\mu$m, a thickness of 0.5 mm with fluctuation of no more than 5 percent, a thermal conductivity of 2 W/m/K, and a Shore A hardness of 55; and an elastic layer comprising a silicone containing elastic material), various compressed image data having equal density areas at both ends in the width direction and three central rows were exposed at reproducible timing and were fed. Thus 100 0.256×0.356 m size sheets of the film F were thermally developed at random timing as well as at timing in which when averaged, one sheet of film F was fed during the time required for two rotations of the drum. The existing ratio of natural number "n" satisfying formulas 3 to 5 was approximately 90 percent. Immediately (within the time required for two rotations of the drum) after successively and thermally developing 100 sheets of film F, 0.356×0.432 m size sheets of film F were thermally developed.

Experiment 2

Employing the above-mentioned thermal development apparatus, by varying the image data of Experiment 1 to nearly similar image data, 100 0.356×0.432 m size sheets of film F were thermally developed while the time interval, until the sheet of film F was fed, was controlled to be nearly similar to the time required for two rotations of the drum. The existing ratio of natural number "n" satisfying formulas 3 to 5 was approximately 60 percent. Immediately (within the time required for two rotations of the drum) after successively and thermally developing these 100 sheets of film F, 0.356×0.432 m size sheets of film F were thermally developed.

Experiment 3

Comparative Example

Employing the above-mentioned thermal development apparatus, by varying the image data of Experiment 1 to nearly similar image data, 100 0.256×0.356 m size sheets of film F were thermally developed while the time interval, until the sheet of film F was fed, was controlled to be perfectly equal to the time required for two rotations of the drum. The existing ratio of natural number "n" satisfying formulas 3 to 5 was almost 0 percent. Immediately (within the time required for two rotations of the drum) after successively and thermally developing these 100 sheets of film F, 0.356×0.432 m sheets of film F were thermally developed.

Experiment 4

Employing the above-mentioned thermal development apparatus, by increasing the conveying speed until the conveying direction altering section 145, exposure was carried out at timing of longer time interval than the shortest time interval Tmin, while the shortest time interval Tmin satisfied the formula of Tmin=0.9×TR, as well as at timing in which various compressed image data having equal density areas at both ends in the width direction and the three central rows had been able to be reproduced, and then the exposed sheets were fed. Thus 100 0.256×0.356 m size sheets of the film F were thermally developed at random timing as well as at timing in which when averaged, one sheet of film F was fed during the time required for one rotation of the drum. The existing ratio of natural number "n" satisfying formulas 3 to 5 was approximately 80 percent. Immediately (within the time required for two rotations of the drum) after successively and thermally developing these 100 sheets of film F, 0.356×0.432 m size sheets of film F were thermally developed.

Experiment 5

Employing the above-mentioned thermal development apparatus, by increasing the conveying speed until the conveying direction altering section 145, exposure was carried out at timing of longer time interval than the shortest time interval Tmin, while the shortest time interval Tmin satisfied the formula of Tmin=1.1×TR, as well as at timing in which various compressed image data having equal density areas at both ends in the width direction and three central rows had been able to be reproduced, and the exposed sheets were fed. Thus 100 0.256×0.356 m size sheets of the film F were thermally developed at random timing as well as at timing in which when averaged, one sheet of film F was fed during the time required for one rotation of the drum. The existing ratio of natural number "n" satisfying formulas 3 to 5 was approximately 90 percent. Immediately (within the time required for two rotations of the drum) after successively and thermally developing these 100 sheets of film F, 0.356×0.432 m size sheets of film F were thermally developed.

Experiment 6

Comparative Example

Employing the above-mentioned thermal development apparatus, by increasing the conveying speed until reaching the conveying direction altering section 145, 100 sheets of the above-mentioned film F were thermally developed while controlled so that the time interval of a 0.256×0.356 m size sheet of film F supplied from the same image data is exactly equal to the time required for one rotation of the drum. The existing ratio of natural number "n" was 0 percent. Immediately (within the time required for one rotation of the drum) after successively and thermally developing these 100 sheets of film F, 0.356×0.432 m size sheets of film F were thermally developed.

Experiments 7 Through 12

Experiments 7 through 12 were carried out in the same manner as Experiments 1 through 6, except that the modified thermal development apparatus described above is comprised of all rollers 16 composed of solid steel rollers having a diameter of 2 cm; aluminum holding tube 36 of the drum 14, having a length of 45.7 cm, an outer diameter of 16 cm, and a wall thickness of 0.72 cm; flexible layer 38 having a surface roughness between 2.3 and 3.2 $\mu$m, a thickness of 0.5 mm with fluctuation of no more than 5 percent, a thermal conductivity of 2 W/m/K, and a Shore A hardness of 55; and an elastic layer comprising a silicone containing elastic material.

Evaluation 1: Maximum density difference in film

The densities of leading edge, center, and rear edge in the conveying direction of each of 100 sheets of film were measured by a densitometer. The maximum density difference of the measured sheets was obtained. The maximum value among obtained maximum density differences was used for evaluation.

Evaluation 2: Visual Evaluation

One hundred sheets of film F were visually evaluated employing the criteria described below.

Criteria

A: no uneven density was found and excellent images were obtained

B: uneven density was found in some sheets, though it was difficult to identify uneven density, and substantially excellent images were obtained C: uneven density was found in some sheets, however it was commercially viable D: uneven density was found, and it was somewhat commercially viable E: uneven density was clearly found and it was not commercially viable F: noticeable uneven density was found in the 5th and following sheets which were not commercially viable G: noticeable uneven density was found in the 2nd or 3rd sheet and all following sheets which were not commercially viable Evaluation 3: Maximum density difference in 0.356×0.432 m size Immediately after successively and thermally developing 100 0.356×0.432 m size sheets of film F, densities of the leading edge, center, and rear edge in the conveying direction of thermally developed sheets were measured employing a densitometer, and the maximum density difference in the measured sheet was obtained.

Evaluation 4: Immediately after successively and thermally developing 100 0.356×0.432 m size sheets of film F, thermally developed sheets were visually evaluated according to the criteria described below.

A: no uneven density was found and excellent images were obtained

B: slight uneven density was found, though it was difficult to identify uneven density, and substantially excellent images were obtained C: slight uneven density was found, however the images were commercially viable D: uneven density was found, and then it was somewhat commercially viable E: uneven density was clearly found in the center of the image and the images were not commercially viable F: noticeable uneven density was found in the center of the image, which was not commercially viable G: highly noticeable uneven density was found in the center of the image, which was not commercially viable Experimental Results

| Experiment | Tmin | Evaluation 1 | Evaluation 2 | Evaluation 3 | Evaluation 4 | |
|---|---|---|---|---|---|---|
| Experiment 1 | 38.3 | 0.10 | A | 0.10 | A | Example |
| Experiment 2 | 38.3 | 0.15 | C | 0.20 | C | Example |
| Experiment 3 | 38.3 | 0.25 | F | 0.30 | F | Comparative Example |
| Experiment 4 | 22.1 | 0.20 | C | 0.20 | C | Example |
| Experiment 5 | 26.9 | 0.20 | C | 0.15 | C | Example |
| Experiment 6 | 24.5 | 0.30 | G | 0.35 | G | Comparative Example |
| Experiment 7 | 38.3 | 0.10 | A | 0.10 | A | Example |
| Experiment 8 | 38.3 | 0.15 | C | 0.20 | C | Example |
| Experiment 9 | 38.3 | 0.25 | F | 0.30 | F | Comparative Example |
| Experiment 10 | 22.1 | 0.10 | A | 0.10 | A | Example |
| Experiment 11 | 26.9 | 0.10 | A | 0.10 | A | Example |
| Experiment 12 | 24.5 | 0.30 | G | 0.35 | G | Comparative Example |

According the present invention, the undesirable generation of uneven density in thermally developable material is minimized.

What is claimed is:

1. A thermal development apparatus, comprising:

a drum having a heating surface on an outer circumferential surface thereof and rotated at a predetermined rotation speed, the heating surface heating a sheet like thermally developable material having a latent image to a predetermined thermally-developing temperature so that the latent image of the heated thermally developable material is visualized; and a feeding device to serially feed and load a plurality of the sheet-like thermally developable materials on the heating surface of the drum such that a loaded position of a leading edge of a succeeding thermally developable material on the heating surface among the plurality of the sheet-like thermally developable materials is shifted from a loaded position of a leading edge of a preceding thermally developable material on the heating surface.

2. The thermal development apparatus of claim 1, wherein a shortest time interval to feed the plurality of the sheet-like thermally developable materials one after another Tmin and a time period TR required for a single rotation of the drum satisfy formula 1, formula 1:

$$(N-1/20)\times TR \geqq Tmin$$

or $$(N+1/20)\times TR \leqq Tmin$$

Where N is an arbitrary natural number.

3. The thermal development apparatus of claim 2, wherein the shortest time interval Tmin and the time period TR satisfy formula 2, formula 2:

$$(N-1/20)\times TR \geqq 2\times Tmin,$$

or $$(N+1/20)\times TR \leqq 2\times Tmin.$$

4. The thermal development apparatus of claim 3, wherein assuming that a time period required for a single rotation of the drum is TR, a time interval between a time when a leading edge of a thermally developable material is fed at n-th order to the drum and a time when a leading edge of a thermally developable material is fed at (n+1)-th order to the drum is T(n), and n represents an arbitrary natural number; an existing ratio of natural number n which satisfy all formula 3 to 5 is 50% or more, formula 3:

$$(N-1/20)\times TR \geqq T(n)$$

or $$(N+1/20)\times TR \leqq T(n)$$

formula 4:

$$(N-1/20)\times TR \geqq T(n+1)$$

or $$(N+1/20)\times TR \leqq T(n+1),$$

formula 5:

$$(N-1/20)\times TR \geqq T(n)+T(n+1)$$

or $$(N+1/20)\times TR \leqq T(n)+T(n+1).$$

5. The thermal development apparatus of claim 4, wherein the feeding device feeds the thermally developable material to the drum through a predetermined feeding path at a predetermined conveying speed, there is provided an exposing device to expose the thermally developable material on the feeding path, the exposing device exposes on the basis of image data produced with a random time interval the thermally developable material with the shortest time interval Tmin or with a random time interval if an exposing time interval exceeds the shortest time interval Tmin, and the feeding device feeds the thermally developable material onto the drum with a random time interval if a feeding time interval exceeds the shortest time interval Tmin.

6. The thermal development apparatus of claim 5, wherein the feeding device has on the feeding path a conveying direction changing section to change the conveying direction by conveying out the thermally developable material in a conveying-out direction different from a conveying-in direction in which the thermally developable material is conveyed in; the conveying direction changing section conveys out a following thermally developable material with a feeding time interval not shorter than the shortest time interval Tmin after conveying out a pre vious thermally developable material.

7. The thermal development apparatus of claim 6, wherein the feeding device feeds thermally developable materials having different size in length along the rotation direction of the drum to the drum, a diameter D of the outer circumference of the drum and the maximum length Lmax of a thermally developable material along the rotation direction of the drum among the thermally developable materials fed by the feeding device satisfy formula 6, formula 6:

$$\pi \times D < 2 \times Lmax$$

($\pi$ is the circular constant).

8. The thermal development apparatus of claim 7, wherein a diameter D of the outer circumference of the drum holding a thermally developable material and a minimum length Lmin of a thermally developable material along the rotation direction of the drum among the thermally developable materials fed by the feeding device satisfy formula 7, formula 7:

$$Lmin < \pi \times D$$

(n is the circular constant).

9. The thermal development apparatus of claim 8, wherein the drum heats a thermally developable material with a developing temperature not lower than 80° C. during a predetermined thermal developing time period.

10. The thermal development apparatus of claim 9, wherein the drum is provided with a plurality of rollers which are rotatable and pressed onto the drum, the thermally developable materials are held on the outer circumferential surface of the drum by the plurality of rollers, the shortest time interval Tmin is not longer than 27 seconds, and at least a first roller firstly coming in contact with the thermally developable material among the plurality of rollers is a solid roller.

11. The thermal development apparatus of claim 9, wherein the apparatus is further provided with a guide member pressed onto the drum so as to hold the thermally developable materials on the outer circumferential surface of the drum, an elastic layer having a thickness of 0.0001 (m) or more is provided on the outer circumferential surface of the drum and the drum is provided with a supporting member made of a metal to support the elastic layer directly or indirectly.

12. The thermal development apparatus of claim 11, wherein the shortest time interval Tmin is not longer 27 seconds, the thickness of the elastic layer is not thicker than 0.0007 (m), and a ratio of a thermal conductivity (W/m/K) to the thickness of the elastic layer is not larger than 500 ($W/m^2/K$).

13. The thermal development apparatus of claim 11, wherein the shortest time interval Tmin is not longer 27 seconds, and the shortest time interval Tmin and the time period TR required for a single rotation of the drum satisfy formula 8 or 9, formula 8:

$$19/20 \times TR \geqq Tmin \geqq 21/40 \times TR$$

formula 9:

$$26/20 \times TR \geqq Tmin \geqq 21/40 \times TR.$$

14. The thermal development apparatus of claim 13, wherein the shortest time interval Tmin and the time period TR required for a single rotation of the drum satisfy formula 10, formula 10:

$$19/20 \times TR \geqq Tmin \geqq 21/40 \times TR.$$

15. The thermal development apparatus of claim 11, further comprising a heater controller, wherein a temperature sensor and a heater are provided in close contact with the inner circumference of the metallic supporting member, the heater controller controls heating by the heater in accordance with a temperature detected by the temperature sensor, and a control target temperature at the timing to feed the thermally developable materials onto the surface of the drum is higher than that at the other timing.

16. The thermal development apparatus of claim 15, wherein a lamp processing is conducted at the control for the heating by the heater.

17. The thermal development apparatus of claim 11, wherein a temperature sensor and a heater provided in close contact with the metallic supporting member are provided on each of plural regions on the inner circumference of the metallic supporting member divided in a direction of an axis of the drum, and assuming that a control target temperature of a heater located at a region corresponding to a region on which the thermally developable materials do not pass over is Te11 at the timing to heat the thermally developable materials and Te12 at the other timing and a control target temperature of a heater located at a region corresponding to a region on which the thermally developable materials pass over is Te21 at the timing to heat the thermally developable materials and Te22 at the other timing, Te11, Te12, Te21 and Te22 satisfy formula 11, formula 11:

$$Te11 - Te12 < Te21 - Te22.$$

18. A thermally developing method for developing a thermally developable material by using a thermal development apparatus comprising a drum to heat a sheet-like thermally developable material on an outer circumferential surface thereof while rotating at a predetermined rotation speed and a feeding device to feed the thermally developable material onto the outer circumferential surface of the drum, wherein the thermal development apparatus thermally develops the thermally developable material fed by the feeding device by heating the thermally developable material to a thermally developing temperature not lower than 80° C. while holding the thermally developable material on the outer circumferential surface of the drum, comprising steps of:

feeding a sheet-like thermally developable material containing silver halide light sensitive particles, an organic silver salt, and a silver ion reducing agent onto the outer circumferential surface of the drum, wherein the lowest thermally developing temperature of the thermally developable material is not lower than 80° C.; and heating the thermally developable material so as to thermally develop the thermally developable material while holding the thermally developable material on the outer circumferential surface of the drum;

wherein an existing ratio of natural number n which satisfy all of formulas 3 to 5 is 50% or more in terms of an arbitrary natural number N;

formula 3

$$(N-1/20)\times TR \geqq T(n)$$

or $$(N+1/20)\times TR \leqq T(n),$$

formula 4

$$(N-1/20)\times TR \geqq T(n+1)$$

or $$(N+1/20)\times TR \leqq T(n+1),$$

formula 5

$$(N-1/20)\times TR \geqq T(n)+T(n+1)$$

or $$(N+1/20)\times TR \leqq 2T(n)+T(n+1)$$

wherein TR denotes a time required for a single rotation of the drum and T(n) denotes an interval between a time when a leading edge of a thermally developable material is fed at n-th order to the drum and a time when a leading edge of the following thermally developable material is fed at (n+1)-th order to the drum.

19. A thermal development apparatus comprising a feeding means for feeding a sheet-like thermally developable material and a drum to heat a sheet of thermally developable material fed from the feeding means while holding the sheet of thermally developable material against the outer circumferential surface and rotating at a substantially constant speed, the thermally developable materials having plurality of different lengths along the rotational direction of said drum are developed, and a diameter D of the outer circumferential surface circle of the drum holding the sheet of thermally developable material and a minimum length Lmin in the rotational direction of the sheet of thermally developable material satisfy the following formula, $$Lmin < \pi \times D$$

(n is the circular constant).

20. The thermal development apparatus of claim 19, wherein the diameter D of the outer circumferential surface circle of the drum holding the sheet of thermally developable material and a maximum length Lmax in the rotational direction of the sheet of thermally developable material satisfy the following formula, $$n \times D < 2 \times Lmax$$

(n is the circular constant).

21. The thermal development apparatus of claim 19, wherein the thermally developable material contains silver halide light sensitive particles, an organic silver salt, and a silver ion reducing agent, is not substantially thermally developed with a temperature not higher than 40° C., and is thermally developed with a temperature not lower than a lowest thermally developing temperature not lower than 80° C.

22. The thermal development apparatus of claim 19, wherein the drum heats the thermally developable material with a development temperature higher than a lowest development temperature during a thermal development time period.

23. The thermal development apparatus of claim 19, further comprising a roller which is rotatable and pressed onto the drum.

24. The thermal development apparatus of claim 19, further comprising an elastic layer having a thickness of 0.1 mm or more.

25. The thermal development apparatus of claim 19, wherein the elastic layer has a thickness not greater than 2 mm and a thermal conductivity of 0.4 (W/m≧k), and the drum comprises a metallic supporting member to support the elastic layer.

26. The thermal development apparatus of claim 19, wherein the feeding means feeds the thermally developable material to the drum in such a timing that the feeding means shifts in a rotational direction of the drum a position at which a leading edge of a sheet of the thermally developable material is to be loaded on the drum from a position of a sheet of the thermally developable material which are previously heated by the drum.

27. The thermal development apparatus of claim 19, further comprising an exposing device to expose the thermally developable material so as to form a latent image on the thermally developable material.

28. A thermal development apparatus comprising a feeding means for feeding a sheet-like thermally developable material and a drum to heat a sheet of thermally developable material fed from the feeding means while holding the sheet of thermally developable material against the outer circumferential surface and rotating at a substantially constant speed, a time period TR required for one rotation of the drum and a time interval T between a time when the leading edge of the sheet of thermally developable material is fed to the drum and a time when that of the following one is fed to the drum satisfy the formula described below;

$$T \neq N \times TR$$

wherein N denotes an arbitrary natural number.

29. The thermal development apparatus of claim 28, wherein the time period TR and the time interval T satisfy the following formula;

$$(N-1/20)\times TR \geqq T$$

or $$(N+1/20)\times TR \leqq T$$

wherein N denotes an arbitrary natural number.

30. A thermal development apparatus comprising a feeding means for feeding a sheet-like thermally developable material and a drum to heat a sheet of thermally developable material fed from the feeding means while holding the sheet of thermally developable material against the outer circumferential surface and rotating at a substantially constant speed, an existing ratio of natural numbers which satisfy all formulas described below is 50 percent or more;

$$(N-1/20)\times TR \geqq T(n)$$

or $$(N+1/20)\times TR \leqq T(n),$$

and $$(N-1/20)\times TR \geqq T(n+1)$$

or $$(N+1/20)\times TR \leqq T(n+1),$$

and $$(N-1/20)\times TR \geqq T(n)+T(n+1)$$

or $$(N+1/20)\times TR \leqq T(n)+T(n+1)$$

wherein TR represents a time period required for one rotation of the drum and T(n) represents a time interval between a time when the leading edge of the sheet of thermally developable material fed at n-th order is fed to the drum and a time when that of the sheet of thermally developable material fed at (n+1)-th order is fed to the drum, and N denotes an arbitrary natural number.

31. A thermal development method, comprising steps of:

rotating a drum whose outer circumferential surface is heated at a substantially constant rotational speed;

feeding a first sheet of thermal developable material onto the outer circumferential surface of the drum;

heating the fed first sheet of thermally developable material to a predetemined thermally-developing temperature by holding the fed first sheet of thermally developable material onto the outer circumferential surface of the drum over a predetermined time period so that a latent image of the heated thermally developable material is visualized;

removing the first sheet of thermally developable material from the outer circumference of the drum; and feeding a second sheet of thermally developable material so as to follow the first sheet of thermally developable material onto the outer circumferential surface of the drum while shifting a position of a leading edge of the second sheet of thermally developable material in the rotational direction of the drum from the position of the leading edge of the first sheet of thermally developable material;

heating the second sheet of thermally developable material by holding the second sheet of thermallv developable material onto the outer circumferential surface of the drum over a predetermined time period; and removing the second sheet of thermally developable material from the outer circumference of the drum.

* * * * *